US008695571B2

(12) United States Patent
Suzuki et al.

(10) Patent No.: US 8,695,571 B2
(45) Date of Patent: Apr. 15, 2014

(54) FLUID PRESSURE REGULATION APPARATUS AND FUEL SUPPLY APPARATUS

(75) Inventors: Hiromasa Suzuki, Toyota (JP); Masaki Akagi, Okazaki (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 48 days.

(21) Appl. No.: 13/520,264

(22) PCT Filed: Feb. 10, 2010

(86) PCT No.: PCT/JP2010/000811

§ 371 (c)(1),
(2), (4) Date: Jul. 2, 2012

(87) PCT Pub. No.: WO2011/099055

PCT Pub. Date: Aug. 18, 2011

(65) Prior Publication Data

US 2012/0312395 A1 Dec. 13, 2012

(51) Int. Cl.
*F02M 69/54* (2006.01)

(52) U.S. Cl.
USPC ..... 123/457; 123/458; 137/496; 137/510

(58) Field of Classification Search
USPC ..... 123/457, 458, 463; 137/496, 508, 509, 137/510
See application file for complete search history.

(56) References Cited

U.S. PATENT DOCUMENTS

| | | | | |
|---|---|---|---|---|
| 3,771,507 | A * | 11/1973 | Silvester | 123/463 |
| 4,310,142 | A * | 1/1982 | Ludwig | 251/30.03 |
| 4,606,317 | A | 8/1986 | Jauch et al. | |
| 4,829,964 | A * | 5/1989 | Asayama | 123/463 |
| 5,069,111 | A * | 12/1991 | Loffler et al. | 91/516 |
| 5,558,063 | A * | 9/1996 | Minagawa et al. | 123/457 |
| 5,758,626 | A * | 6/1998 | Maley | 123/506 |
| 7,188,610 | B2 * | 3/2007 | Crary et al. | 123/457 |
| 7,878,179 | B2 * | 2/2011 | Ikeya | 123/457 |
| 8,210,156 | B2 * | 7/2012 | Kokotovic et al. | 123/458 |
| 8,517,050 | B2 * | 8/2013 | Akagi et al. | 137/479 |
| 2003/0234002 | A1 * | 12/2003 | Rivera | 123/454 |
| 2009/0151703 | A1 | 6/2009 | Ikeya | |
| 2009/0212248 | A1 * | 8/2009 | Kozak | 251/129.17 |
| 2011/0042598 | A1 * | 2/2011 | Kozak | 251/129.17 |

FOREIGN PATENT DOCUMENTS

| | | |
|---|---|---|
| JP | A-60-224968 | 11/1985 |
| JP | A-2009-108684 | 5/2009 |
| JP | A-2009-144686 | 7/2009 |

OTHER PUBLICATIONS

Apr. 13, 2010 International Search Report issued in International Patent Application No. PCT/JP2010/000811.

* cited by examiner

*Primary Examiner* — Thomas Moulis
(74) *Attorney, Agent, or Firm* — Oliff PLC

(57) ABSTRACT

To provide a fluid pressure regulation apparatus and a fuel supply apparatus which are compact in arrangement and simple in construction, a pressure regulator includes a housing, a pressure adjustment member constituted by a partition wall forming together with the housing a pressure adjustment member held in communication with a fluid introduction opening and having the pressure adjustment chamber brought into communication with a fluid discharge opening in response to the pressure of fluid in the pressure adjustment chamber. The pressure regulator is capable of adjusting the fluid pressure in the pressure adjustment chamber to a preliminarily set pressure, and has one surface side thereof forming an area of a pressure receiving range receiving the fluid pressure, the area being variably set and the set pressure being varied in response to the area of the pressure receiving range.

17 Claims, 8 Drawing Sheets

FLUID PRESSURE REGULATION APPARATUS AND FUEL SUPPLY APPARATUS

TECHNICAL FIELD

The present invention relates to a fluid pressure regulation apparatus and a fuel supply apparatus, and more particularly to a fluid pressure regulation apparatus suitable for regulating fuel supply pressure to a fuel consumption unit when the fuel reserved in a fuel tank is supplied to the fuel consumption unit by a fuel pump, and to a fuel supply apparatus provided with the fluid pressure regulation apparatus.

BACKGROUND ART

The fuel supply apparatus for the internal combustion engine to be mounted on an automotive vehicle, comprises a fuel tank for reserving the fuel, a fuel pump for pumping up the fuel from the fuel tank to supply the fuel to injectors, and a fluid pressure regulation apparatus such as a pressure regulator and the like for adjusting the fuel supply pressure (hereinafter simply referred to as "fuel pressure") when the fuel is supplied to the fuel consumption unit by the fuel pump. The fluid pressure regulation apparatus is adapted to adjust the fuel supply pressure to injectors forming part of the fuel consumption unit with the fuel pump for pumping up the fuel from the fuel tank. The fluid pressure regulation apparatus of this kind is generally provided with a housing, and a diaphragm provided in the housing to separate the housing into two chambers and has an adjustment valve at the central portion thereof. The diaphragm has one surface side receiving the fuel pressure in one of the adjustment chambers to have the central portion deformed in the directions to close or open the adjustment valve in response to the fuel pressure varied in the adjustment chamber, and has the other surface side held in engagement with a spring (compression coil spring) to have the diaphragm suppressed from being deformed. The fluid pressure regulation apparatus thus constructed is adapted to have the pressure adjustment valve held in the closed state until the fuel pressure in the pressure adjustment chamber reaches the set pressure. Further, the fluid pressure regulation apparatus is usually disposed in the fuel tank together with the fuel pump.

As a fluid pressure regulation apparatus of this kind, for example, is known a pressure regulator which comprises a housing, a diaphragm disposed in the housing to separate the housing into two chambers, a pressure adjustment chamber positioned at the one surface side of the diaphragm and having a fuel introduction port in which the pressurized fuel to be introduced from the fuel pump and a fuel discharge port through which the surplus fuel to be discharged, a back pressure chamber positioned at the other surface side of the diaphragm to allow back pressure fluid to be introduced therein, a plunger slidably disposed in the housing and formed with an open chamber opened to the atmosphere between the diaphragm and the back pressure chamber, a valve portion member attached with the diaphragm to selectively open or close the fuel discharge opening in response to the displacement of the diaphragm, a spring interposed between the diaphragm and the plunger to urge the valve portion member in a direction having the valve portion member closed, and a stopper unit for defining the movement range of the plunger. The fuel supply apparatus provided with the pressure regulator thus constructed is adapted to switch the set loads of the spring into two stages depending on whether or not the back pressure fluid is supplied to the back pressure chamber, thereby making it possible to switch the regulation pressure value between a low pressure value and a high pressure value (for example see Patent Document 1).

Another conventional fluid pressure regulation apparatus, for example, comprises first and second diaphragms separating a housing into three pressure chambers, a valve body attached with the first diaphragm to selectively open or close the pressure regulating discharge port in the first pressure chamber formed between the housing and the first diaphragm, a pressure receiving member connected to the valve body through a connecting rod disposed in the second pressure chamber between the first and second diaphragms and secured to the second diaphragm, and a spring disposed in the third pressure chamber between the housing and the second diaphragm to urge the pressure receiving member in a direction having the valve body closed. The fuel supply apparatus provided with the pressure regulator thus constructed is adapted to control the pressure of the fuel supplied to the second and third pressure chambers, thereby making it possible to switch the fuel pressure to be adjusted into three stages (for example see Patent Document 2).

CITATION LIST

Patent Literature

{PTL1}
Patent Document 1: Japanese Patent Application Publication No. 2009-144686
{PTL2}
Patent Document 2: Japanese Patent Application Publication No. 2009-108684

SUMMARY OF INVENTION

Technical Problem

The fluid pressure regulation apparatus and the fuel supply apparatus so far developed as previously mentioned, however, encounter difficulties in downsizing the apparatuses resulting from the fact that the housing having the pressure regulator accommodated therein has three pressure chambers separated from each other in spite of a narrow space in which the fluid pressure regulation apparatus and the fuel supply apparatus are arranged. One of the reasons for the difficulties with the arrangement of the fluid pressure regulation apparatus and the fuel supply apparatus is that the pipe arrangement is necessary at each side of the pressure regulation chamber and the back pressure chamber. In addition, as the fluid pressure is introduced into the chamber other than the chamber facing the one surface side of the diaphragm forming part of the pressure regulation chamber, not only the number of elements or parts required to have adequate seal properties is increased but also throttling means and the like come to be necessary, thereby resulting in increased production costs of the apparatuses.

In particular, the fuel supply apparatus so far developed to have three stages in which the fuel pressure to be regulated is switched requires to have the first to third pressure chambers formed with fuel introduction ports and discharge ports, respectively, and thus encounters such a problem that the pipes to and from these pressure chambers are extremely complicated in arrangement.

In view of the foregoing drawbacks of the conventional apparatuses, the present invention has an object to provide a fluid pressure regulation apparatus and a fuel supply apparatus having pipes simple in construction and compact in arrangement.

Solution to Problem

In order to solve the above problems, (1) the fluid pressure regulation apparatus according to the present invention comprising: a housing formed to have a fluid introduction opening through which fluid is introduced, and a fluid discharge opening through which the fluid is discharged, and in the housing formed a pressure adjustment chamber which is held in communication with the fluid introduction opening, and a pressure adjustment member in the form of a partition wall and capable of communicating the fluid introduction opening with the fluid discharge opening in response to the fluid pressure in the pressure adjustment chamber, the fluid pressure in the pressure adjustment chamber being adjustable to a preliminarily set pressure, the pressure adjustment member forming an area of a pressure receiving range receiving the fluid pressure at one surface side, the area being variably set, and the set pressure being varied in response to the area of the pressure receiving range.

By the above construction of the fluid pressure regulation apparatus as set forth in the above definition (1), the fluid pressure regulation apparatus thus constructed can vary the area of the pressure receiving range receiving the fluid pressure when the pressure adjustment member receives the fluid pressure in one of its displacement directions, e.g., a valve opening direction. The area thus varied of the pressure receiving range leads to varying the urging force to urge the pressure adjustment member in the valve opening direction and to varying the fluid discharge amount discharged from the pressure adjustment chamber, thereby making it possible to change the set pressure. It is therefore not required to introduce the operation pressure fluid into the chamber other than the chamber facing the one surface side of the diaphragm forming part of the pressure adjustment chamber needed in the conventional apparatus, thereby making it possible to make the pipes compact in arrangement and simple in construction. Moreover, the set pressure of the pressure adjustment chamber can be at a high set pressure when the fluid pressure acts only on the pressure receiving range facing the pressure adjustment chamber at the one surface side of the diaphragm and does not act on the other pressure receiving range at the one surface side of the diaphragm (at the non-pressurization time). This makes it possible to facilitate promptly starting the fluid supply at a sufficient fuel pressure at the time of restarting supplying the pressurized fuel by maintaining the set pressure of the fluid pressure regulation apparatus at a high pressure for example when the fuel supply operation by the fuel supply circuit of the fuel targeted for the pressure adjustment is stopped.

In the fluid pressure regulation apparatus according to the present invention as set forth in the above definition (1), (2) it is preferable that a plurality of fluid pressure introduction passages are formed at the one surface side of the pressure adjustment member partly forming the pressure adjustment chamber, and the fluid pressure is selectively introduced to the plurality of fluid pressure introduction passages to variably set the area of the pressure receiving range.

By the above construction of the fluid pressure regulation apparatus as set forth in the above definition (2), the fluid pressure regulation apparatus thus constructed can introduce the fluid pressure into any one of the plurality of fluid pressure introduction passages, or into two or more of the plurality of fluid pressure introduction passages to vary the area of the pressure receiving range of the pressure adjustment member. If the areas of the pressure receiving ranges facing the plurality of fluid pressure introduction passages are differentiated from each other to have the fluid pressure selectively introduced into any one of the plurality of fluid pressure introduction passages, the pressure receiving area of the pressure adjustment member can be varied.

The fluid pressure regulation apparatus according to the present invention as set forth in the above definition (2), (3) preferably further comprises an opening/closing valve operative to be opened to introduce the fluid into any one of the fluid pressure introduction passages and to be closed to regulate the introduction of the fluid in the case that a plurality of fluid pressure introduction passages are formed to be partitioned from each other.

By the above construction of the fluid pressure regulation apparatus as set forth in the above definition (3), the fluid pressure regulation apparatus thus constructed can have the introduction of the fluid pressure into any one of the plurality of fluid pressure introduction passages or into two or more of the plurality of fluid pressure introduction passages selectively switched, thereby making it possible to easily vary the area of the pressure receiving range of the pressure adjustment member.

In the fluid pressure regulation apparatus according to the present invention as set forth in the above definition (2) or (3), (4) the pressure adjustment member includes a partition wall portion forming the pressure adjustment chamber together with the housing, and a movable valve body portion displaceable in an opening direction having the pressure adjustment chamber brought into communication with the fluid discharge opening in response to the fluid pressure in the pressure adjustment chamber, the housing being provided therein with a first valve seat portion and a second valve seat portion, the first valve seat portion partly forming at the one surface side of the pressure adjustment member a discharge passage held in communication with the fluid discharge opening and a first fluid pressure introduction passage held in communication with the fluid introduction opening, the first valve seat portion being operative to allow the discharge passage to be brought into communication with the first fluid pressure introduction passage in response to the displacement of the movable valve body portion, the second valve seat portion partly forming at the one surface side of the pressure adjustment member a second fluid pressure introduction passage allowing the fluid pressure to be introduced therein, the second valve seat portion being operative to allow the discharge passage to be brought into communication with the second fluid pressure introduction passage in response to the displacement of the movable valve body portion.

By the above construction of the fluid pressure regulation apparatus as set forth in the above definition (4), the fluid pressure regulation apparatus thus constructed can decrease the area of the pressure receiving range for the pressure adjustment member to receive the fluid pressure in the valve opening direction and thus reduce the amount of discharge fluid, thereby making it possible to adjust the fluid in the first fluid pressure introduction passage to a high pressure when the pressurized fluid is supplied only to any one of the plurality of fluid pressure introduction passages, e.g., the first fluid pressure introduction passage forming the pressure adjustment member, but is not supplied to the second fluid pressure introduction passage. When, on the other hand, the pressurized fluid is supplied to both of the first fluid pressure introduction passage and the second fluid pressure introduction passage, the area of the pressure receiving range of the pressure adjustment member is increased, and thereby the fluid pressure of the first fluid pressure introduction passage forming the pressure adjustment chamber is adjusted to a low pressure. If the areas of the first and second pressure receiving ranges facing the first and second fluid pressure introduction passages are differentiated from each other to have the fluid pressure introduced selectively into the first fluid pressure introduction passage or into the second fluid pressure introduction passage, the pressure receiving area of the pressure adjustment member can be varied. It is therefore not required to introduce the operation fluid into the chamber other than the chamber facing the one surface side of the diaphragm forming part of the pressure adjustment chamber needed in the conventional apparatus. In addition, the first fluid pressure introduction passage or the second fluid pressure introduction passage serves as part of the switching operation pressure introduction passage at the time of the adjustment to the low fluid pressure, thereby making it possible to make the pipes compact in arrangement and simple in construction. As a consequence, the fluid pressure regulation apparatus can have the pipes compact in arrangement and simple in construction. Moreover, the fluid pressure regulation apparatus can have a high pressure adjusted when one of the chambers is supplied with no pressurized fluid, thereby making it possible to facilitate promptly starting the fluid supply at a sufficient fuel pressure at the time of restarting supplying the pressurized fuel by maintaining the set pressure of the fluid pressure regulation apparatus at a high pressure for example when the fuel supply operation by the fuel supply circuit of the fuel targeted for the pressure adjustment is stopped.

In the fluid pressure regulation apparatus according to the present invention as set forth in the above definition (4), (5) the first valve seat portion and the second valve seat portion are preferably disposed in concentric relationship with each other. By the above construction of the fluid pressure regulation apparatus according to the present invention, it is possible to easily bring the pipes into line with each other in the same direction and to have the pipes connected with the housing at the desired positions in the outer peripheral direction of the housing.

In the fluid pressure regulation apparatus according to the present invention as set forth in the above definition (4) or (5), (6) the first valve seat portion and the second valve seat portion are preferably arranged in the same direction in opposing relationship with the movable valve body portion of the pressure adjustment member and to have respective valve seat surfaces in parallel relationship with each other. By the above construction of the fluid pressure regulation apparatus according to the present invention, it is possible to make simple in construction the movable valve body portion, the first valve seat portion, and the second valve seat portion and to easily produce the pressure adjustment member having the movable valve body portion supported on the partition wall portion such as a diaphragm and the like.

In the fluid pressure regulation apparatus according to the present invention as set forth in the above definition (6), (7) the movable valve body portion of the pressure adjustment member preferably has a flat surface facing the first valve seat portion and the second valve seat portion. By the above construction of the fluid pressure regulation apparatus according to the present invention, the pressure adjustment member can be produced at a low cost.

In the fluid pressure regulation apparatus according to the present invention as set forth in any one of the above definitions (4) to (7), (8) the first valve seat portion and the second valve seat portion are respectively constituted by the end portions of an outer cylindrical member and an inner cylindrical member disposed in coaxial relationship with each other, the fluid introduction opening formed in the housing is positioned at the outer peripheral surface side of the outer cylindrical member, and the fluid discharge opening formed in the housing is positioned at the inner peripheral surface side of the outer cylindrical member. By the above construction of the fluid pressure regulation apparatus according to the present invention, the pressure receiving range can easily be set and arranged at the partition wall portion such as the diaphragm and the like receiving the pressure of the fluid to be introduced through the fluid introduction opening at the peripheral portion of the movable valve body portion, and can easily set the fluid passage from the fluid introduction opening to the fluid discharge opening to the cross-sectional passage area which is difficult for its pressure loss to be generated even with a maximum amount of fluid passing through the fluid passage. Here, the inner peripheral surface side of the outer cylindrical member includes a cylindrical space between the outer cylindrical member and the inner cylindrical member, and a space in a column shape at the inner surface side of the inner cylindrical member.

In the case of the adoption of the arrangement of the fluid introduction opening and the fluid discharge opening as previously described, (9) the fluid pressure regulation apparatus may be constructed in such a manner that the discharge passage is formed between the outer cylindrical member and the inner cylindrical member, and the second fluid pressure introduction passage is formed at the inner surface side of the inner cylindrical member, or otherwise, (10) the fluid pressure regulation apparatus may be constructed in such a manner that the discharge passage is formed at the inner peripheral surface side of the inner cylindrical member, and the second fluid pressure introduction passage is formed between the outer cylindrical member and the inner cylindrical member. In each case, the presence or absence of the supply of the pressurized fuel to one of the first fluid pressure introduction passage and the second fluid pressure introduction passage, for example, the second fluid pressure introduction passage makes it possible to vary the pressure adjustment set value, thereby leading to increased degrees of freedom in designing this kind of apparatus. When any one of the fluid pressure introduction passages, for example, the second fluid pressure introduction passage is substantially closed, a negative pressure region is formed in the vicinity of the facing portion between the second valve seat portion and the movable valve body portion due to the fact that the flow of the fluid from the fluid pressure introduction passage to the fluid pressure discharge passage is separated from the surface of the movable valve body portion, or resulting from the Venturi effect and the like.

In the fluid pressure regulation apparatus according to the present invention as set forth in any one of the above definitions (4) to (10), (11) the partition wall portion of the pressure adjustment member preferably partly forms a back pressure chamber together with the housing to impart the back pressure to the pressure adjustment chamber, the back pressure chamber accommodates therein a resilient member to resiliently urge the movable valve body portion of the pressure adjustment member in a closing direction, and the fluid pressure in the pressure adjustment chamber is adjusted to a high fluid pressure when the fluid pressure in the second fluid pressure introduction passage is released, and the fluid pressure in the pressure adjustment chamber is adjusted to a low fluid pressure when the fluid pressure in the second fluid pressure introduction passage is pressurized. By the above construction of the fluid pressure regulation apparatus according to the present invention, the urging force of the resilient member makes it possible to obtain a stable back pressure. Moreover, the high pressure side adjustment set value can be made sufficiently high, while securing a sufficient amount of discharge flow at the time of the low fluid pressure adjustment.

In the fluid pressure regulation apparatus according to the present invention as set forth in the above definition (11), (12) the partition wall portion of the pressure adjustment member is preferably constituted by a flexible diaphragm, and the movable valve body portion of the pressure adjustment member is preferably constituted by a valve body plate supported on the central portion of the diaphragm to be in opposing relationship with the first valve seat portion and the second valve seat portion. By the above construction of the fluid pressure regulation apparatus according to the present invention, the pressure adjustment member can simply be constructed and produced at a low cost.

On the other hand, (13) the fuel supply apparatus according to the present invention is provided with the fluid pressure regulation apparatus as set forth in any one of the above definitions (1) to (12), in which the pressure of fuel to be supplied to a fuel consumption unit is adjusted by the fluid pressure regulation apparatus.

By the above construction of the fluid pressure regulation apparatus according to the present invention, the area of the pressure receiving range of the pressure adjustment member is decreased to have the fuel in the pressure adjustment chamber adjusted to the high pressure when the pressurized fluid is not supplied to both of the first and second fluid pressure introduction passages of the fluid pressure regulation apparatus (or any one of the fluid pressure introduction chambers having a large pressure receiving area in both of the fluid pressure introduction passages; hereinafter the same in this paragraph). When, on the other hand, the pressurized fluid is supplied to both of the first and second fluid pressure introduction passages, the area of the pressure receiving range of the pressure adjustment member is increased to have the fuel in the pressure adjustment chamber adjusted to the low pressure. This means that any one of the first and second fluid pressure introduction passages, for example, the second fluid pressure introduction passage serves as part of the operation pressure introduction passage used for switching the set pressure at the time of low fuel pressure adjustment, thereby making it possible to provide a fluid pressure regulation apparatus which has pipes compact in arrangement and simple in construction. Moreover, the high pressure adjustment can be achieved when the pressurized fluid is not supplied to any one of the fluid pressure introduction passages, so that it is possible to easily start supplying the fuel at a sufficiently high pressure promptly at the time of restarting supplying the fuel by maintaining the set pressure of the fluid pressure regulation apparatus at a high pressure level when the supply of the fuel (pressurized) to the fuel consumption unit is stopped. This makes it possible to downsize the fuel pump and thus reduce the power to be consumed by the fuel pump.

Further, (14) the fuel supply apparatus according to the present invention is preferably provided with the fluid pressure regulation apparatus having the first and second fluid pressure introduction passages and a fuel supply circuit that supplies the fuel to a fuel consumption unit through a check valve, in which the first fluid pressure introduction passage of the fluid pressure regulation apparatus is connected to a circuit portion at the downstream side of the check valve of the fuel supply circuit, and the second fluid pressure introduction passage of the fluid pressure regulation apparatus is connected to a circuit portion at the upstream side of the check valve of the fuel supply circuit. By the above construction of the fuel supply apparatus according to the present invention, the remaining pressure of the fuel in the vicinity of the fuel consumption unit at the downstream of the check valve can be retained, and the operation pressure fuel for the switching of the pressure adjustment level can be easily obtained, and moreover the power consumption of the fuel supply apparatus can be reduced.

The fuel supply apparatus as set forth in the above definition (14), (15) further preferably comprises an opening/closing valve capable of switching the state selectively to a closing valve state in which the second fluid pressure introduction passage is closed or to an opening valve state in which the second fluid pressure introduction passage is opened, and when the opening/closing valve is switched to the closing valve state in the state in which the fuel flows from the fluid introduction opening to the fluid discharge opening, the flow of the fuel causes negative pressure to be generated in the vicinity of the facing portion between the movable valve body portion and the second valve seat portion and between the movable valve body portion and the second fluid pressure introduction passage. By the above construction of the fuel supply apparatus according to the present invention, the pressure adjustment level of the fuel pressure can be switched selectively to the high pressure side or to the low pressure side by the operation of the opening/closing valve. The opening/closing valve selected to be a usually opened type or a usually closed type makes it possible for the opening/closing valve to be switched and driven to obtain the high pressure side or low pressure side set adjustment pressure only when required, thereby enabling the power consumption to be reduced. Further, the high pressure adjustment can be achieved when the operation pressure is not supplied to the second fluid pressure introduction passage, so that it is possible to easily start supplying the fuel at a sufficient high pressure promptly at the time of restarting supplying the pressurized fuel by maintaining the set pressure of the fluid pressure regulation apparatus at a high pressure level when the supply of the fuel to the fuel consumption unit is stopped by the fuel pump. This makes it possible to downsize the fuel pump and thus reduce the power to be consumed by the fuel pump. In addition, the fluid pressure regulation apparatus can utilize the negative pressure in the vicinity of the second fluid pressure introduction passage at the time of the high fuel pressure adjustment, and thereby can perform the operation corresponding to the increased back pressure against the pressure adjustment member, thereby making it possible to obtain a sufficient fuel pressure at the time of the high fuel pressure adjustment.

In the fuel supply apparatus as set forth in the above definition (15), in which (16) the partition wall portion of the pressure adjustment member preferably separates the inside of the housing into the pressure adjustment chamber and the back pressure chamber imparting the back pressure to the pressure adjustment chamber, and which further preferably comprises a back pressure switching valve for selectively introducing the fluid pressure into the back pressure chamber to vary the pressure in the back pressure chamber. By the above construction of the fuel supply apparatus according to the present invention, the back pressure in the back pressure chamber can be varied by the switching operation of the back pressure switching valve, thereby making it possible to set the set value of the fuel pressure to be adjusted in pressure at more multiple stages.

In the fuel supply apparatus as set forth in any one of the above definitions (13) to (16), (17) in which the fuel consumption unit is preferably a fuel injection portion of an internal combustion engine. By the above construction of the fuel supply apparatus according to the present invention, the set pressure of the fluid pressure regulation apparatus can be retained at the high pressure state during the stopping operation of the internal combustion engine only with the pressurized fluid stopped to be supplied when the internal combustion engine is stopped, so that it is possible to start supplying the fuel at a sufficient high pressure promptly when the internal combustion engine is started or when the pressurized fuel is restarted to be supplied at the high temperature restarting time of the engine, thereby making it possible to reduce the energy consumption at the starting time of the engine. Further, the fuel pressure reduced at the usual operation of the engine makes it possible to reduce the energy consumption of the fuel pump and the like.

Further, the pressurized fluid herein described is not limited to the fluid having the fluid pressure pressurized and supplied through the fluid supply circuit previously mentioned but may include fluid pressurized to the pressure lower than the pressure of the fuel while being pressurized and supplied through the fluid supply circuit. It may be considered that the switching operation is performed at multi-stage pressure adjustment values with the varied pressure of the operation pressure fluid. Furthermore, the first valve seat portion and the second valve seat portion are to be disposed at the one surface side of the pressure adjustment member in the form of a partition wall, viz., at the same side with the pressure adjustment chamber, however, a plurality of any one or both of these valve seat portions may be disposed at the one surface side.

Advantageous Effects of Invention

The present invention can provide a fluid pressure regulation apparatus which has pipes simple in construction and compact in arrangement and a fuel supply apparatus provided with the fluid pressure regulation apparatus.

DESCRIPTION OF EMBODIMENTS

Figure 1:
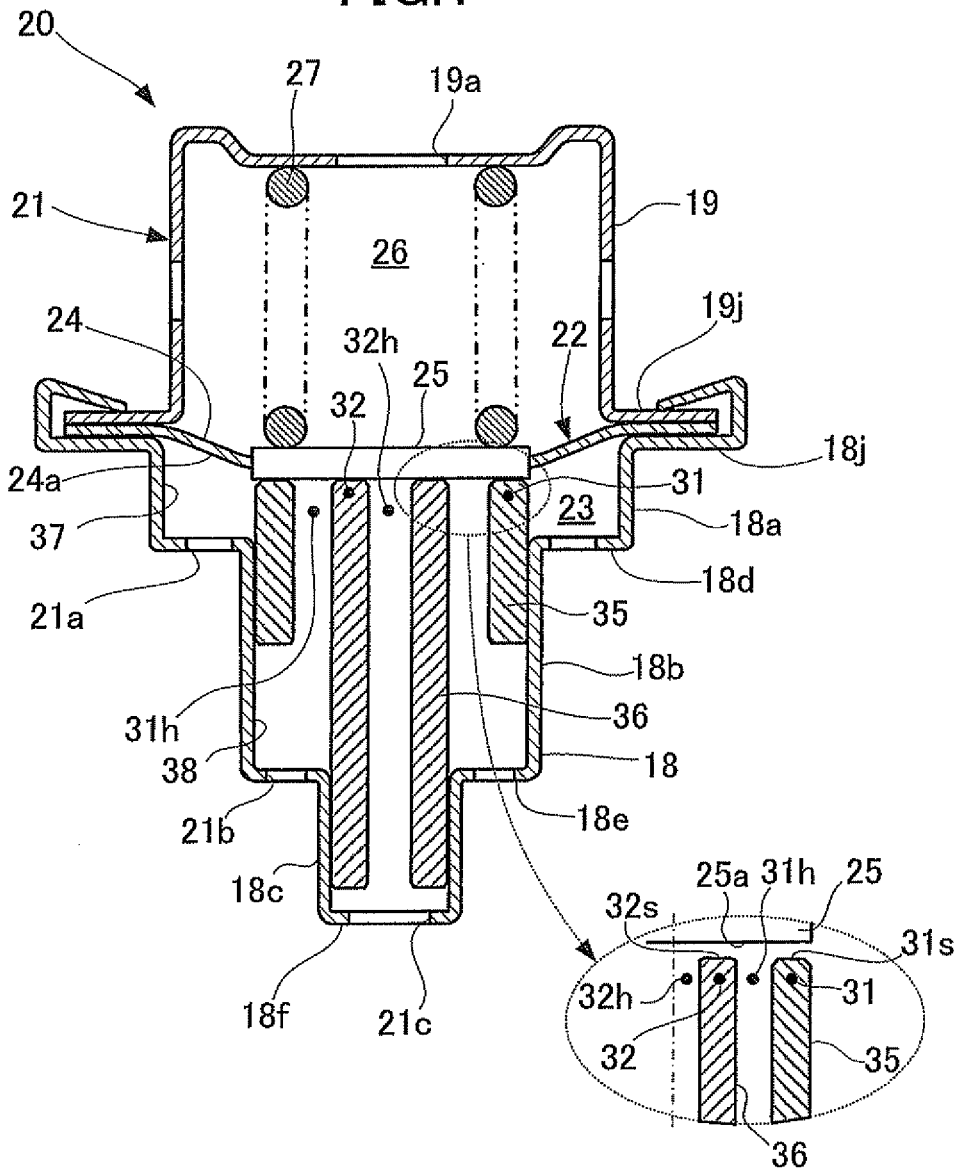
FIG. 1 is a cross-sectional view of a fluid pressure regulation apparatus according to the first embodiment of the present invention.

The preferred embodiment of the present invention will be described hereinafter with reference to the accompanying drawings.

First Embodiment

Each of FIGS. 1 to 4 shows a fluid pressure regulation apparatus and a fuel supply apparatus provided with the fluid pressure regulation apparatus according to the first embodiment of the present invention. The present embodiment will be explained about a fluid pressure regulation apparatus which is applied to a fuel supply apparatus of an internal combustion engine used for a vehicle. The entire construction of a fuel supply system is not shown in the drawings, however, the fuel supply apparatus according to the present embodiment is of what is called an in-tank type which is accommodated in a sub-tank provided in a fuel tank. The fuel supply apparatus according to the present embodiment is constructed to have a jet pump known in construction and operative to supply the fuel in the fuel tank to the engine. The jet pump transports limited amount of the fuel only to be incessantly consumed by the engine through a communication passage from the pump to the engine. The communication passage is branched with a branch return passage connected with the sub-tank, so that a surplus amount of fuel discharged from the pump can be returned through the branch return passage to the sub-tank in response to the amount of fuel returning in the branch return passage.

The construction of the fuel supply apparatus according to the present embodiment will be explained hereinafter.

Figure 2:
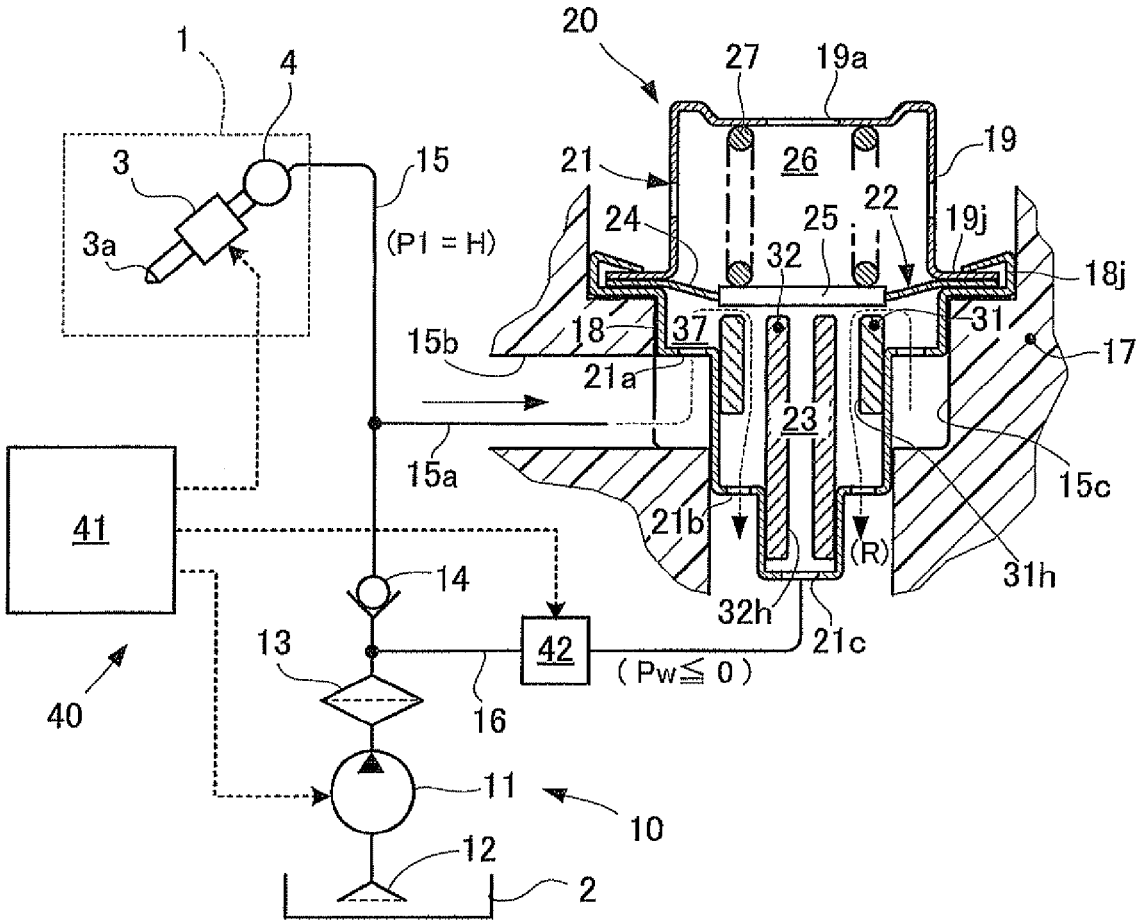
FIG. 2 is a schematic construction view of a fuel supply apparatus provided with the fluid pressure regulation apparatus according to the first embodiment of the present invention.

As shown in FIGS. 1 and 2, the fuel supply apparatus according to the present embodiment comprises a fuel tank 2 for storing the fuel such as for example gasoline (fluid) to be consumed at an engine 1 (fuel consumption unit), and a fuel supply circuit 10 (fluid supply circuit) for pressurizing and supplying the fuel stored in the fuel tank 2 to a plurality of injectors 3 (only one injector shown in FIG. 2) forming part of the engine 1. The fuel supply apparatus further comprises a pressure regulator 20 (fluid pressure regulation apparatus) which is supplied through the fuel supply circuit 10 with the fuel to be fed to the injectors 3. The pressure regulator 20 is capable of regulating the pressure of the fuel to a system pressure P1 preliminarily set, viz., variably controlling the pressure of the fuel between a high pressure side set pressure and a low pressure side set pressure one of which is selectively switched from the other. The fuel supply apparatus further comprises a set pressure switching unit 40 that can control the set pressure of the pressure regulator 20 to be switched to one desired set pressure selected from between the high pressure side set pressure and the low pressure side set pressure.

The engine 1 is constructed by a multi-cylinder type of internal combustion engine to be mounted on an automotive vehicle which is exemplified by a four-cycle gasoline engine. This engine 1 has a plurality of cylinders each having an injector 3 having an injection nozzle side end portion 3*a* exposed in an intake port (not shown) formed in each of the cylinders. The fuel from fuel supply circuit 10 is delivered to each of the injectors 3 by way of a delivery pipe 4.

The fuel supply circuit 10 is constructed to include a fuel pump 11 for pressurizing and discharging the fuel after pumping up the fuel from the fuel tank 2, a suction filter 12 provided at a suction port side of the fuel pump 11 to check foreign materials from being introduced through the suction port, a fuel filter 13 provided at a discharge port side of the fuel pump 11 to remove the foreign materials contained in the fuel, and a check valve 14 (check valve) positioned at the downstream side of the fuel filter 13.

The fuel pump 11 is not shown in detail but generally includes a pump operation portion having an impeller functioning for a pumping action, and a built-in DC motor for driving the pump operation portion, so that the fuel pump 11 can pump up the fuel from the fuel tank 2 before pressurizing and discharging the fuel and is capable of variably controlling the discharge amount of fuel per unit time with the action of the built-in motor operated to have a rotational speed {rpm} varied. The check valve 14 is designed to be opened to allow the fuel to flow in the fuel supply direction to the injectors 3 from the fuel pump 11 and, on the other hand, to be closed to check the pressurized and discharged fuel from being returned to the fuel pump 11 from the injectors 3.

The fuel pump 11 is adapted to be controlled by an electronic control unit (hereinafter simply referred to as "ECU") 41 operative for the energization of the built-in motor to have the built-in motor selectively driven or stopped, thereby making it possible to have the fuel discharge amount of fuel per unit time varied. The ECU will become apparent as the description proceeds.

The pressure regulator 20 is provided with a housing 21 formed to have a fluid introduction opening 21*a* through which the fuel is introduced, and a fluid discharge opening 21*b* through which the fuel is discharged. The housing 21 is formed by a pair of housing members 18, 19 in the form of a cavity with outer peripheral flange portions 18*j*, 19*j* respectively forming parts of the housing members 18, 19 and coupled with each other under a caulked state. The fluid introduction opening 21*a* and the fluid discharge opening 21*b* are arranged to be equally spaced apart from one another in the circumferential direction of the housing 21. In place of the fluid introduction opening 21*a* and the fluid discharge opening 21*b* previously mentioned, at least one fluid introduction opening 21*a* and at least one fluid discharge opening 21*b* may be arranged at any respective positions in the circumferential direction of the housing 21 and may be in any respective opening shapes according to the present invention. The housing members 18, 19 are constructed for example by press working a steel plate or a stainless steel plate into the respective concave shapes in the present embodiment. However, the housing members 18, 19 may be molded into the shapes as shown from a molten material or a powder material according to the present invention.

As shown in FIG. 1, the housing 21 is provided therein with a pressure adjustment member 22 in the form of a partition wall to separate the inner space of the housing 21 into two chambers. The pressure adjustment member 22 comprises a partition wall portion 24 and a movable valve body portion 25. The partition wall portion 24 forms together with the housing 21*a* pressure adjustment chamber 23 which is held in communication with the fluid introduction opening 21*a*. The movable valve body portion 25 is movable in a direction to open the passage from the fluid introduction opening 21*a* to the fluid discharge opening 21*b*, and capable of having the pressure adjustment chamber 23 held into communication with the fluid discharge opening 21*b* at an opening degree variable in response to the fuel pressure in the pressure adjustment chamber 23. The partition wall portion 24 and the movable valve body portion 25 are integrally formed with each other. The partition wall portion 24 has one surface to always receive the fuel pressure in the pressure adjustment chamber 23. The partition wall portion 24 of the pressure adjustment member 22 has the other surface forming together with the housing 21*a* back pressure chamber 26 accommodating therein the fuel which imparts the back pressure to the pressure adjustment chamber 23. In the back pressure chamber 26 is provided a compression coil spring 27 (resilient member) which resiliently urges the movable valve body portion 25 of the pressure adjustment member 22 in a direction to close the passage from the fluid introduction opening 21*a* to the fluid discharge opening 21*b*. The back pressure chamber 26 is formed by the pressure adjustment member 22 and the housing member 19, the latter of which is formed with at least one atmospheric pressure introduction opening 19*a*. The atmospheric pressure introduction opening 19*a* can of course allow the fuel under a low pressure almost equal to the atmospheric pressure in the tank 12 to be introduced therethrough.

More specifically, the partition wall portion 24 of the pressure adjustment member 22 is constructed by, for example, a flexible diaphragm having components including a base fabric material layer (for example a polyimide synthetic fiber and the like) and a rubber layer (for example hydrogenated nitrile rubber, fluorine-containing rubber and the like) difficult to be deteriorated by the fuel. The flexible diaphragm is produced by integrally adhering the base fabric material layer and the rubber layer to each other. The movable valve body portion 25 of the pressure adjustment member 22 is constructed by a valve body plate in the form of a disc and made of for example a metal (for example a tool steel, a stainless steel and the like) which is supported on the central portion of the partition wall portion 24. The movable valve body portion 25 and the partition wall portion 24 are attached with each other for example by vulcanizing the rubber layer.

On the other hand, in the housing 21 are disposed a first valve seat portion 31 and a second valve seat portion 32 in concentric relationship with each other and in opposing relationship with the movable body portion 25 of the pressure adjustment member 22 in the pressure adjustment chamber 23. The first valve seat portion 31 and the second valve seat portion 32 are respectively constituted by the end portions of an outer cylindrical member 35 and an inner cylindrical member 36 different in diameter from each other and coaxially arranged with respect to each other. Here, the first valve seat portion 31 is formed at its inner peripheral side with a discharge passage 31*h* held in communication with the fluid discharge opening 21*b* and having an opening degree variable in response to the displacement of the movable valve body portion 25. The second valve seat portion 32 is formed at its inner peripheral side with a fuel pressure introduction passage 32*h* having an opening degree variable in response to the displacement of the movable valve body portion 25. The fuel pressure introduction passage 32*h* is adapted to allow the fuel (hereinafter simply referred to as "operation pressure fuel") pressurized to the degree imparting the operation force to the movable valve body portion 25 to be selectively introduced therein.

Further, the movable valve body portion 25 of the pressure adjustment member 22 has a flat surface 25*a* facing the first valve seat portion 31 and the second valve seat portion 32. The first valve seat portion 31 and the second valve seat portion 32 are arranged in the same direction (upwardly in FIG. 1) in opposing relationship with the movable valve body portion 25 of the pressure adjustment member 22 and to have respective valve seat surfaces 31*s*, 32*s* substantially in the same plane with each other and in parallel relationship with each other.

When the movable valve body portion 25 of the pressure adjustment member 22 is held in engagement with the first valve seat portion 31, the inner end of the discharge passage 31*h* of the first valve seat portion 31 is liquid hermetically closed, however, the inner end of the fuel pressure introduction passage 32*h* of the second valve seat portion 32 may not be necessarily liquid hermetically closed although the inner end of the fuel pressure introduction passage 32*h* of the second valve seat portion 32 is throttled in opening degree by the movable valve body portion 25. This means that the distance between the flat surface 25*a* of the movable valve body portion 25 and the first valve seat portion 31 may be set to be slightly smaller than the distance between the flat surface 25*a* of the movable valve body portion 25 and the second valve seat portion 32 so as to form an extremely small gap between the movable valve body portion 25 and the second valve seat portion 32 when the movable valve body portion 25 of the pressure adjustment member 22 is held in engagement with the first valve seat portion 31. Here, the valve seat surfaces 31*s*, 32*s* of the first valve seat portion 31 and the second valve seat portion 32 have respective inner and outer peripheral edge portions chamfered.

The first valve seat portion 31 and the second valve seat portion 32 are, more specifically, accommodated in and securely supported by the housing member 18 formed in a stepped concave, so that the depth of the space in the housing member 18 becomes deeper toward the center axis of the housing member 18. The housing member 18 has a first annular wall portion 18*a* radially outwardly spaced apart from the outer cylindrical member 35, a second annular wall portion 18*b* supporting the outer cylindrical member 35, and a third annular wall portion 18*c* supporting the inner cylindrical member 36. The housing member 18 further has a first stepped wall portion 18*d* connecting the first annular wall portion 18*a* and the second annular wall portion 18*b* with each other, a second stepped wall portion 18*e* connecting the second annular wall portion 18*b* and the third annular wall portion 18*e* with each other, and a third stepped wall portion 18*f* connected with the outer end portion of the third annular wall portion 18*c*.

The fluid introduction opening 21*a* formed in the housing 21 is positioned at the outer peripheral surface side (radially outwardly) of the outer cylindrical member 35, while the fluid discharge opening 21*b* formed in the housing 21 is positioned at the inner peripheral surface side (radially inwardly) of the outer cylindrical member 35.

In other words, the fluid introduction opening 21*a* of the housing 21 is opened in the first stepped wall portion 18*d* positioned between the outer cylindrical member 35 and the first annular wall portion 18*a* of the housing member 18. The housing member 18 of the housing 21, the partition wall portion 24 of the pressure adjustment member 22, and the outer cylindrical member 35 collectively form an annular introduction side passage 37 allowing the fuel to be introduced therein from the fluid introduction opening 21*a* to have the pressure of the fuel received on the partition wall portion 24. Further, the fluid discharge opening 21*b* of the housing 21 is opened in the second stepped wall portion 18*e* positioned between the outer cylindrical member 35 and the second annular wall portion 18*b* of the housing member 18. The discharge passage 31*h* of the first valve seat portion 31 is formed in a roughly cylindrical shape by the outer cylindrical member 35 and the inner cylindrical member 36 at the inner peripheral surface side of the outer cylindrical member 35 and at the outer peripheral surface side of the inner cylindrical member 36. The discharge passage 31*h* of the first valve seat portion 31 is therefore held in communication with the fluid discharge opening 21*b* of the housing 21 through an annular discharge passage 38 collectively formed by the housing member 18, the outer cylindrical member 35, and the inner cylindrical member 36. Further, the fuel pressure introduction passage 32*h* of the second valve seat portion 32 is formed in a roughly cylindrical column shape in the inner cylindrical member 36. The third stepped wall portion 18*f* of the housing member 18 is formed with a central opening 21*c* held in communication with the fuel pressure introduction passage 32*h* of the second valve seat portion 32.

As will be understood from the foregoing description, the housing 21 is provided therein with the first valve seat portion 31 and the second valve seat portion 32. The first valve seat portion 31 partly forms at the one surface side of the pressure adjustment member 22 the discharge passage 31*h* held in communication with the fluid discharge opening 21*b* and the annular introduction side passage 37 (first fluid pressure introduction passage) held in communication with the fluid introduction opening 21*a*. The first valve seat portion 31 is operative to allow the discharge passage 31*h* to be brought into communication with the annular introduction side passage 37 in response to the displacement of the movable valve body portion 25. The second valve seat portion 32 partly forms at the one surface side of the pressure adjustment member 22 the fluid pressure introduction passage 32*h* (second fluid pressure introduction passage) allowing the fluid pressure to be introduced therein. The second valve seat portion 32 is operative to allow the discharge passage 31*h* to be brought into communication with the fuel pressure introduction passage 32*h* in response to the displacement of the movable valve body portion 25.

Although the present embodiment is constructed to have the fluid introduction opening 21*a* opened in the first stepped wall portion 18*d* and to have the fluid discharge opening 21*b* opened in the second stepped wall portion 18*e*, the fluid introduction opening 21*a* may have an opening shape extending to the first annular wall portion 18*a*, and the fluid discharge opening 21*b* may have an opening shape extending to the second annular wall portion 18*b* according to the present invention. Further, the fluid introduction opening 21*a* may be opened in the first annular wall portion 18*a*, and the fluid discharge opening 21*b* may be opened in the second annular wall portion 18*b* according to the present invention.

On the other hand, the fluid introduction opening 21*a* of the pressure regulator 20 is connected through a branch passage 15*a* to a fuel passage 15 forming a circuit portion of the fuel supply circuit 10 at the downstream of the check valve 14. The fuel pressure introduction passage 32*h* of the pressure regulator 20 is connected to the branch passage 16 forming a circuit portion upstream of the check valve 14 of the fuel supply circuit 10. Here, the branch passage 15*a* of the fuel passage 15 has a branch portion 15*b* and annular passage portion 15*c*, the branch portion 15*b* being formed by part 17 (see FIG. 2) of a filter case accommodating therein the suction filter 12 and the filter element (not shown) of the fuel filter 13 together with the fuel pump 11, and the annular passage portion 15*c* formed between the part 17 of the filter case and the housing 21 of the pressure regulator 20. The branch passage 16 has one end through which the fuel is allowed to be introduced after being discharged from the fuel pump 11 to pass through the fuel filter 13, and the other end which is connected to the central opening 21*c* of the housing 21 held in communication with the fuel pressure introduction passage 32*h*.

The branch passage 16 of the fuel supply circuit 10 has an electromagnet type of pressure adjustment switching valve 42 (opening-closing valve, switching valve) which is operative to be switched between a closed state having the fuel pressure introduction passage 32*h* closed and an opened state having the fuel pressure introduction passage 32*h* opened. The pressure adjustment switching valve 42 has an electromagnet operation unit which is controlled in energization state by the ECU 41, so that the pressure adjustment switching valve 42 can be controlled by the ECU 41 to selectively take a closed state or an open state. The branch passage 16, the pressure adjustment switching valve 42, and the ECU 41 collectively constitute a set pressure switching unit 40 for executing the switching control of the set pressure of the pressure regulator 20 as defined in the present invention.

When the pressure adjustment switching valve 42 forming part of the set pressure switching unit 40 takes the closed state, viz., when the fuel pressure Pw in the fuel pressure introduction passage 32*h* is held in the low pressure (fluid pressure in the non-pressurization state) with no pressurized fluid supplied to the fuel pressure introduction passage 32*h*, the area of a pressure receiving range substantially receiving the fuel pressure in the direction having the movable valve body portion 25 of the pressure adjustment member 22 take the opened state is restricted only to the annular pressure receiving surface 24*a* of the partition wall portion 24 occupying the peripheral portion of the movable valve body portion 25. When, on the other hand, the pressure adjustment switching valve 42 takes the opened state, viz., when the fuel pressure Pw in the fuel pressure introduction passage 32*h* is held in the high pressure (fluid pressure in the pressurization state) with the pressurized fluid supplied to the fuel pressure introduction passage 32*h*, the area of the pressure receiving range substantially receiving the fuel pressure in the direction having the movable valve body portion 25 of the pressure adjustment member 22 take the opened state not only includes the annular pressure receiving surface 24*a* of the partition wall portion 24 occupying the peripheral portion of the movable valve body portion 25 but also the roughly circular pressure receiving surface (the central portion of the flat surface 25*a*) of the central portion of the movable valve body portion 25 facing the second valve seat portion 32 and the fuel pressure introduction passage 32*h*. This means that the presence or absence of the fuel pressurized pressure in the fuel pressure introduction passage 32 makes it possible to increase or decrease the area of the pressure receiving range of the pressure adjustment member 22. The increased or decreased area of the pressure receiving range of the pressure adjustment member 22 causes the thrust force in the direction having the movable valve body portion 25 take the opened state to be varied, thereby varying the deflection amount and the spring force of the compression coil spring 27 urging the movable valve body portion 25 toward the closed state from the back pressure 26. This results in the fact that the presence or absence of the fuel pressurized and supplied to the fuel pressure introduction passage 32*h* causes the movable valve body portion 25 to be displaced in the direction selectively taking the closed state or opened state with respect to the first valve seat portion 31 and the second valve seat portion 32. When the displacement of the movable valve body portion 25 to take the closed state causes the fuel discharge amount from the annular introduction side passage 37 to the fluid discharge opening 21*b* to be decreased, the pressure of the fuel of the annular introduction side passage 37 in the pressure adjustment chamber 23 is adjusted to a high fuel pressure. When, on the other hand, the displacement of the movable valve body portion 25 to take the opened state causes the fuel discharge amount from the annular introduction side passage 37 to the fluid discharge opening 21*b* to be increased, the pressure of the fuel of the annular introduction side passage 37 in the pressure adjustment chamber 23 is adjusted to a low fuel pressure.

When the pressure adjustment switching valve 42 is switched to take the closed state in the opened state of the pressure regulator 20 allowing the fuel to be introduced to the fluid discharge opening 21*b* from the fluid introduction opening 21*a*, the present embodiment is constructed to enable negative pressure to be generated in the vicinity of the facing portion between the movable valve body portion 25 of the pressure adjustment member 22 and the second valve seat portion 32 and the fuel pressure introduction passage 32*h* stemming from the flow of the fuel in the pressure adjustment chamber 23. This results in the fact that the present embodiment can prevent the pressurization state from remaining in the fuel pressure introduction passage 32*h* when the pressure adjustment switching valve 42 is switched to take the closed state.

In this way, the pressure regulator 20 can selectively introduce the fuel discharged from the fuel pump 11 and supplied to the injectors 3 of the engine to any one of the annular introduction side passage 37 in the pressure adjustment chamber 23 and the fluid pressure introduction passage 32*h*, e.g., the fluid pressure introduction passage 32*h*, thereby making it possible to adjust the pressure of the fuel introduced into the annular introduction side passage 37 in the pressure adjustment chamber 23 while being switched to desired one of set pressures selected from among the high pressure side set pressure and the low pressure side set pressure preliminarily set. When the fluid pressurized fluid is stopped to be supplied to the fluid pressure introduction passage 32*h*, the fuel downstream of the check valve 14 in the fluid supply passage 15 to the injectors 3 from the fuel pump 11 can be adjusted in pressure and maintained to the high pressure side set pressure.

The high pressure side set pressure of the pressure regulator 20 is for example 400 {kPa} (gauge pressure; hereinafter the same) which is a set pressure value of the fuel pressure (usually equal to or more than 324 kPa) difficult for fuel vapor to be generated even when the fuel temperature of the fuel in the delivery pipe 4 is maintained at a higher temperature level immediately after the engine stop. The low pressure side set pressure is for example 200 {kPa} which is a set pressure value of the fuel pressure difficult for fuel vapor to be generated when the fuel temperature of the fuel in the delivery pipe 4 is maintained at a relatively low temperature during the travelling of the vehicle.

The ECU 41 is constituted by an input interface circuit, and an output interface circuit in addition to backup memories including nonvolatile memories such as for example a CPU (Central Processing Unit), a ROM (Read Only Memory), a RAM (Random Access Memory), an EEPROM (Electrically Erasable and Programmable Read Only Memory) and the like. The ECU 41 is inputted with an ON/OFF signal outputted by an ignition switch of the vehicle and supplied with electric power from a battery. Further, the input interface circuit of the ECU 41 is connected with various sensors adapted to output their respective signals, i.e., the sensors' information to the ECU 41 through the input interface circuit including an A/D converter and the like. The output interface circuit of the ECU 41 is connected with relay switches, a switching element and the like, the relay switches partly functioning for controlling actuators such as the injectors 3, the fuel pump 11, the pressure adjustment switching valve 42 and the like, and the switching element partly functioning for variably controlling the electric current of the fuel pump 11.

The ECU 41 is adapted to execute the control program stored in the ROM to close the pressure adjustment switching valve 42 at the starting time of the engine 1 or immediately before the stop of the engine 1 and to adjust the pressure of the fuel introduced from the fuel pump 11 to the high pressure side set pressure in the pressure adjustment chamber 23 in accordance with the sensors' information from the various sensors, and the set values and the map information preliminarily stored in the ROM and the backup memory. Further, the ECU 41 is adapted to repeatedly determine the load condition of the engine 1 during the operation of the engine 1 to open the pressure adjustment switching valve 42 and to adjust the pressure of the fuel introduced from the fuel pump 11 to the low pressure side set pressure in the pressure adjustment chamber 23 when the engine 1 is in a partial load operation occupying almost all parts of operation after the engine start, viz., in an operation range other than its high load operation after the engine start. For this reason, the set values stored in the ROM and the backup memory of the ECU 41 include the high pressure side set pressure and the low pressure side set pressure respectively in the fuel pressure. The map information stored in the ROM and the backup memory includes a map and the like for controlling the switching of the fuel pressure in response to the determination of the operation load and the determination results.

Next, the operation of the fuel supply apparatus according to the present embodiment will be explained hereinafter.

In the fuel supply apparatus according to the present embodiment constructed as previously mentioned, the pressure adjustment switching valve 42 is maintained in the closed state with the discharge pressure of the fuel pump 11 being 0 {kPa}, and with the pressure adjustment switching valve 42 being deenergized during the stop of the engine 1.

Figure 3:
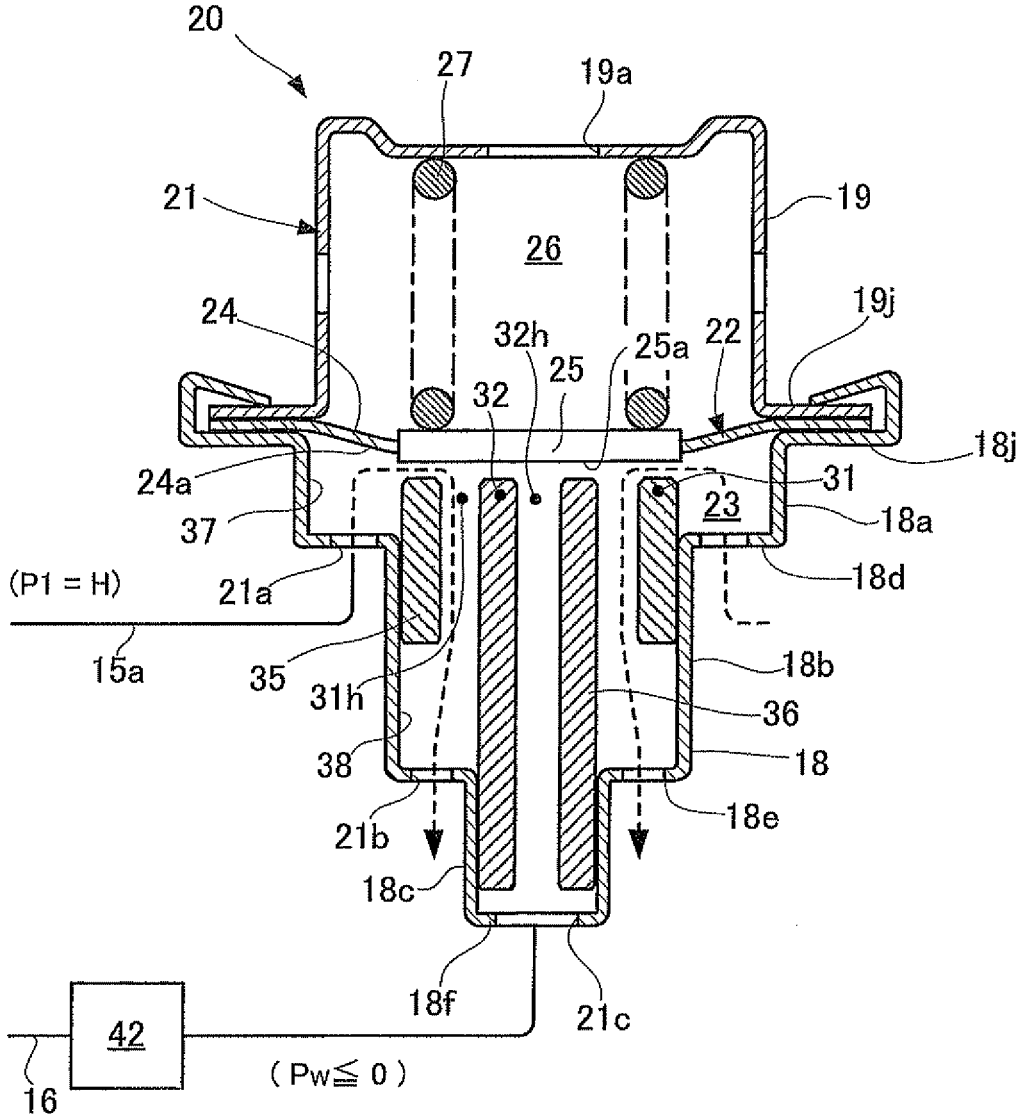
FIG. 3 is a cross-sectional view of an opened valve state at the high fuel pressure regulation time of the fluid pressure regulation apparatus according to the first embodiment of the present invention.

At this time, the fuel pressure introduction passage 32*h* of the pressure regulator 20 is, as shown in FIG. 2 and FIG. 3, supplied with no pressurized fuel, thereby maintaining the fuel pressure at a low pressure in the fuel pressure introduction passage 32*h*, so that the area of the pressure receiving range substantially receiving the fuel pressure in the direction having the movable valve body portion 25 of the pressure adjustment member 22 take the opened state is restricted only to the annular pressure receiving surface of the partition wall portion 24 occupying the peripheral portion of the movable valve body portion 25. As a consequence, the set pressure of the pressure regulator 20 is maintained at a high pressure side in the state of stopping the fuel pressurized and supplied by the fuel supply circuit 10 which is a pressure regulating target.

For starting the engine 1, the ECU 41 is operated to have the fuel pump 11 started to be operated. At this time, the pressure adjustment switching valve 42 is still maintained in the closed state as shown in FIGS. 2, 3. This means that the discharge pressure of the fuel pump 11 is increased, and the fuel from the fuel pump 11 is introduced into the annular introduction side passage 37 in the pressure adjustment chamber 23. At this time, the fuel promptly reaches the high pressure side set pressure, e.g., 400 {kPa}, so that the fuel is supplied by the fuel pump 11 to the delivery pipe 4 through the fuel passage 15 with the high pressure side set pressure as a system pressure P1 of the high fuel pressure. Both at the stop of supplying the pressurized fuel by the fuel supply circuit 10 and at the restarting time of supplying the pressurized fuel by the fuel supply circuit 10, the set pressure of the pressure regulator 20 can be set at a high pressure side, thereby making it possible to promptly start supplying the fuel at a sufficiently high fuel pressure at the restarting time of supplying the pressurized fuel by the fuel supply circuit 10.

On the other hand, in the operation state after a predetermined time lapses from the start of the engine 1, the engine 1 is usually operated in a partial load operation state in which the engine 1 is operated exclusively under a partial load. The above operation state of the engine 1 excludes a specified operation state to request a high fuel pressure, for example, at the time of requesting a high load operation. The above partial load operation state requests a low pressure side set pressure from the aspects of the fuel consumption efficiency and the confidence of the fuel pump 11.

Figure 4:
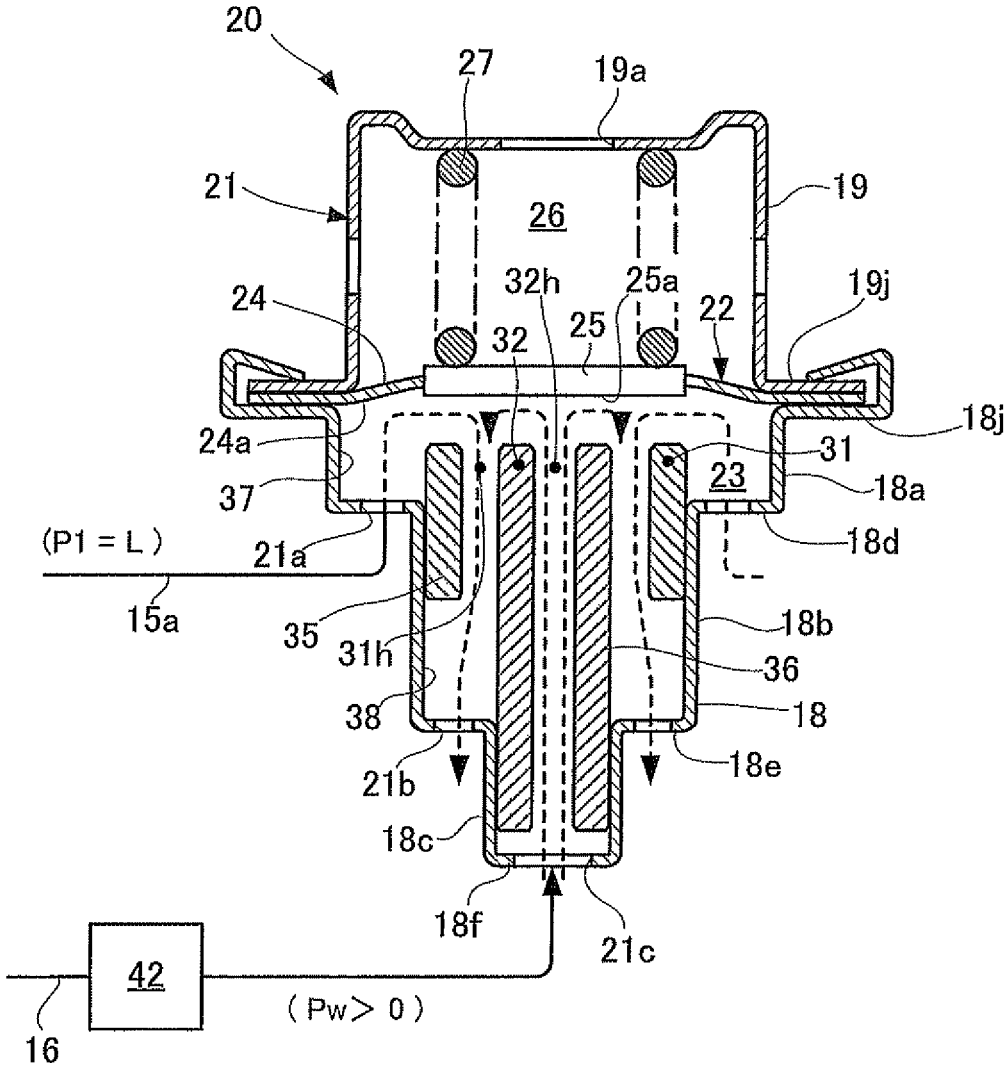
FIG. 4 is a cross-sectional view of an opened valve state at the low fuel pressure regulation time of the fluid pressure regulation apparatus according to the first embodiment of the present invention.

In the partial load operation state of the engine 1, the ECU 41 is operated to control the pressure adjustment switching valve 42 to take the opened state and to have the fuel pump 11 continue the operation as shown in FIG. 4. For the sake of convenience of explanation, FIGS. 3 and 4 show gaps intentionally larger than the actual gaps between the movable valve body portion 25 and the first valve seat portion 31 and between the movable valve body portion 25 and the second valve seat portion 32, however, these gaps are extremely small to the degree at most less than 1 mm even when the gaps are opened to the largest levels, for example, as shown in FIG. 4.

Under these conditions, the fuel pressure introduction passage 32*h* of the pressure regulator 20 is supplied with the pressurized fuel, thereby resulting in the fact that the fuel pressure in the fuel pressure introduction passage 32*h* is increased to the high pressure, and the area of the pressure receiving range of the pressure adjustment member 22 is enlarged to include the roughly circular pressure receiving surface of the central portion of the movable valve body portion 25 facing the second valve seat portion 32 and the fuel pressure introduction passage 32*h* in addition to the annular pressure receiving surface of the partition wall portion 24. In response to the increased area of the pressure receiving range of the pressure adjustment member 22, the thrust force of the movable valve body portion 25 in the direction having the movable valve body portion 25 take its opening valve position is increased, so that the deflection amount and the spring force of the compression coil spring 27 urging the movable valve body portion 25 in the direction having the movable valve body portion 25 take its closing valve position are increased, thereby displacing the movable valve body portion 25 in the direction having the movable valve body portion 25 take its opening valve position with respect to the first valve seat portion 31 and the second valve seat portion 32. The displacement of the movable valve body portion 25 in the direction having the movable valve body portion 25 take its opening valve position causes the discharge amount of the fuel from the annular introduction side passage 37 in the pressure adjustment chamber 23 to the fluid discharge opening 21*b* to be increased, thereby leading to the pressure of the fuel in the pressure adjustment chamber 23 being adjusted to the low fuel pressure.

As previously mentioned in the above description, the pressure regulator 20 according to the present embodiment is constructed to require no operation pressure fluid to be introduced into the back pressure chamber 26, viz., the chamber other than the chamber facing one surface of the pressure adjustment member 22 partly forming the pressure adjustment chamber 23 for switching the fuel pressure between the high and low pressures for the pressure adjustment. The pressure regulator 20 is further constructed to have the fuel pressure introduction passage 32*h* function part of an operation pressure fuel introduction passage to be used for switching the set pressures at the time of adjusting the fuel pressure to the low fuel pressure. This makes it possible to provide the pressure regulator 20 which enables the pipes to be simple in construction and compact in arrangement.

Moreover, the set pressure of the pressure regulator 20 is maintained at a high pressure level when the pressurized fuel to be supplied to the injectors 3 is stopped, thereby making it possible to promptly start supplying the fuel at a sufficiently high pressure to the injectors 3 at the time of restarting supplying the pressurized fuel, and thereby making it possible to downsize the fuel pump 11 and to reduce the consumption power of the fuel pump 11.

The fact that the first valve seat portion 31 and the second valve seat portion 32 are disposed in concentric relationship with each other in the present embodiment makes it possible to facilitate aligning the pipes for introducing and discharging the fuel in the same direction as well as to set the positions where the pipes are connected at desired positions in the outer circumferential direction of the housing 21.

In addition, the first valve seat portion 31 and the second valve seat portion 32 are disposed in face-to-face relationship in the same direction with the movable valve body portion 25 of the pressure adjustment member 22 and have respective valve seat surfaces 31*s*, 32*s* substantially in the same plane with each other and in parallel relationship with each other, and that the movable valve body portion 25 has a flat surface 25*a* facing the first valve seat portion 31 and the second valve seat portion 32. This leads to the fact that the first valve seat portion 31 and the second valve seat portion 32 can be simply constructed, and the pressure adjustment member 22 constructed to have the movable valve body portion 25 in the form of a plate supported on the central portion of the partition wall portion 24 of the diaphragm and the like that can be simple in construction, thereby making it possible to easily produce the pressure regulator 20 at a low cost.

Further, the distance between the flat surface 25*a* of the movable valve body portion 25 and the first valve seat portion 31 is slightly smaller than the distance between the flat surface 25*a* of the movable valve body portion 25 and the second valve seat portion 32 so as to form an extremely small gap between the movable valve body portion 25 and the second valve seat portion 32 when the movable valve body portion 25 of the pressure adjustment member 22 is held in engagement with the first valve seat portion 31. This leads to the fact that the first valve seat portion 31 and the second valve seat portion 32 can easily be produced, and the desired sealing performance can stably be secured at the first valve seat portion 31.

Further, the first valve seat portion 31 and the second valve seat portion 32 are respectively constituted by the end portions of the outer cylindrical member 35 and the inner cylindrical member 36 disposed in coaxial relationship with each other, and the fluid introduction opening 21*a* formed in the housing 21 is positioned at the outer peripheral side of the outer cylindrical member 35, while the fluid discharge opening 21*b* formed in the housing 21 is positioned at the inner peripheral surface side of the outer cylindrical member 35. This leads to the fact that the pressure receiving range can easily be set at the partition wall portion 24 made of a diaphragm and the like receiving the pressure of the fuel introduced from the fluid introduction opening 21*a* radially outwardly of the movable valve body portion 25, and that the fuel passage from the fluid introduction opening 21*a* to the fluid discharge opening 21*b* can easily be set to have a passage cross-sectional area difficult for pressure loss to be generated even with a maximum flow amount of fuel to pass therethrough.

The presence or absence of the fuel pressurized and supplied to the fuel pressure introduction passage 32*h* makes it possible to vary the pressure adjustment set value. In addition, when the fuel pressure introduction passage 32*h* is being closed, the flow of the fuel to the fluid discharge opening 21*b* is separated from the surface of the movable valve body portion 25, thereby forming a negative pressure region in the vicinity of the facing portion between the movable valve body portion 25 and the second valve seat portion 32. The negative pressure area thus formed makes it possible for the compression coil spring 27 to be downsized and to cause a stable urging force in the back pressure imparting direction with a high fuel pressure adjusted.

Further, the fuel supply apparatus according to the present embodiment is constructed to have the fluid introduction opening 21*a* of the pressure regulator 20 connected to the circuit portion of the fuel supply circuit 10 downstream of the check valve 14, and to have the fuel pressure introduction passage 32*h* of the pressure regulator 20 connected to the circuit portion of the fuel supply circuit 10 upstream of the check valve 14, so that the fuel supply apparatus can perform the switching operation of the fuel pressure with the pressure adjustment switching valve 42 which is of a low consumption electric current and of a small size. Moreover, the throttling action of the pressure adjustment switching valve 42 makes it possible to reduce the flow amount of fuel pressurized and introduced into the fuel pressure introduction passage 32*h* to a relatively small and stable amount (the amount proportional to the square root of the fuel pressure upstream of the throttling action), thereby making it possible to carry out the switching operation of the fuel pressure while maintaining the discharge amount of surplus fuel from the fluid discharge opening 21*b* to a stable amount. The pressure adjustment switching valve 42 constructed to take a closed state at all times renders it possible to permit the pressure adjustment switching valve 42 to be switched to take an opened state only when required, and to adjust and set the fuel pressure to the low pressure side set pressure. This makes it possible to suppress the consumption power to a lower level.

It is therefore to be noted that the present embodiment can provide a fuel supply apparatus and a pressure regulator 20 having pipes simple in construction and compact in arrangement as well as being produced at a low cost. Furthermore, the fuel supply apparatus can be low in consumption power.

In addition, the pressure regulator 20 according to the present embodiment is the same as the conventional apparatus of what is called a U-flow type in the aspect of seal structure and only one return path being needed for the apparatus. However, the pressure regulator 20 according to the present embodiment is sufficient in reliability, and needs no large size structure as compared with the conventional apparatus, and can require no outer pipes for adjusting the pressure of the fuel.

Second Embodiment

Figure 5:
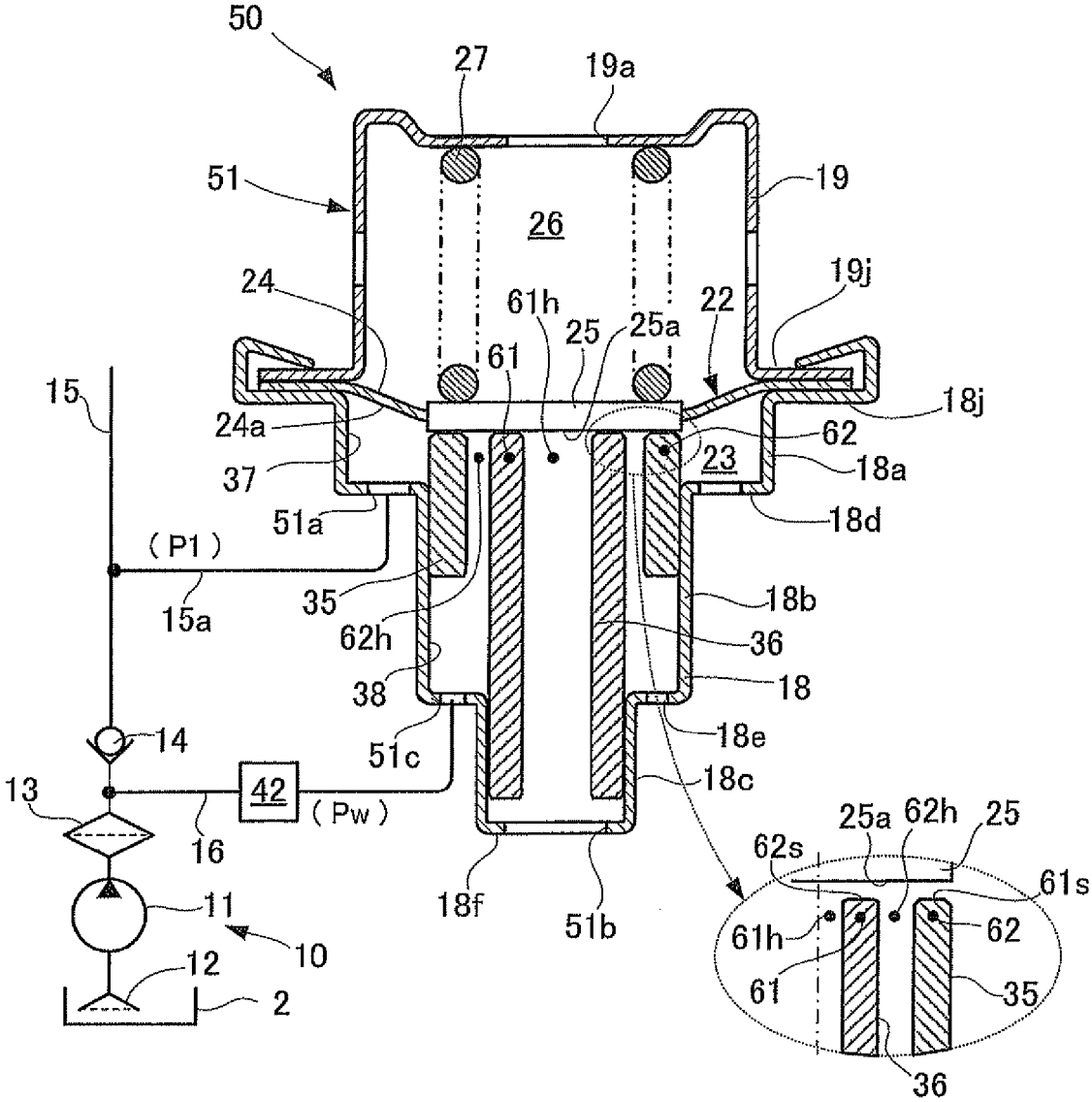
FIG. 5 is a schematic construction view of the fuel supply apparatus according to the second embodiment of the present invention.
Figure 6:
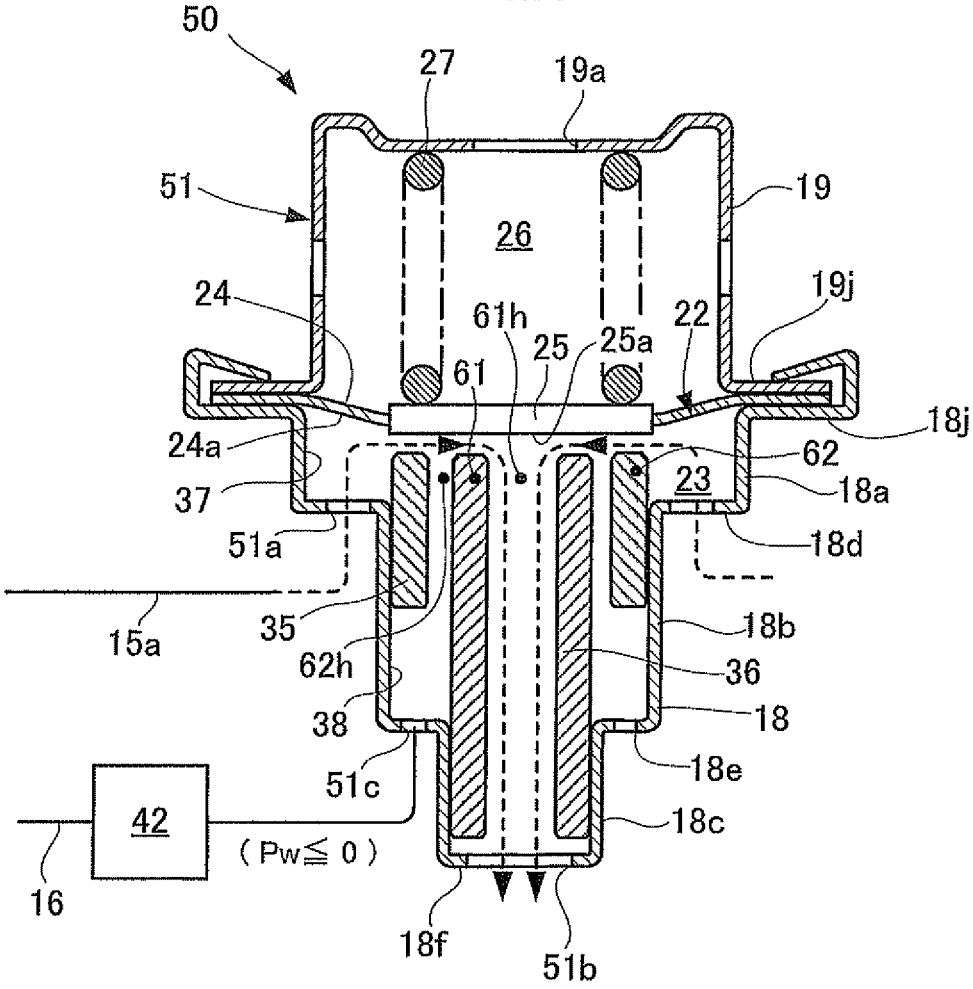
FIG. 6 is a cross-sectional view of an opened state at the high fuel pressure regulation time of the fluid pressure regulation apparatus according to the second embodiment of the present invention.
Figure 7:
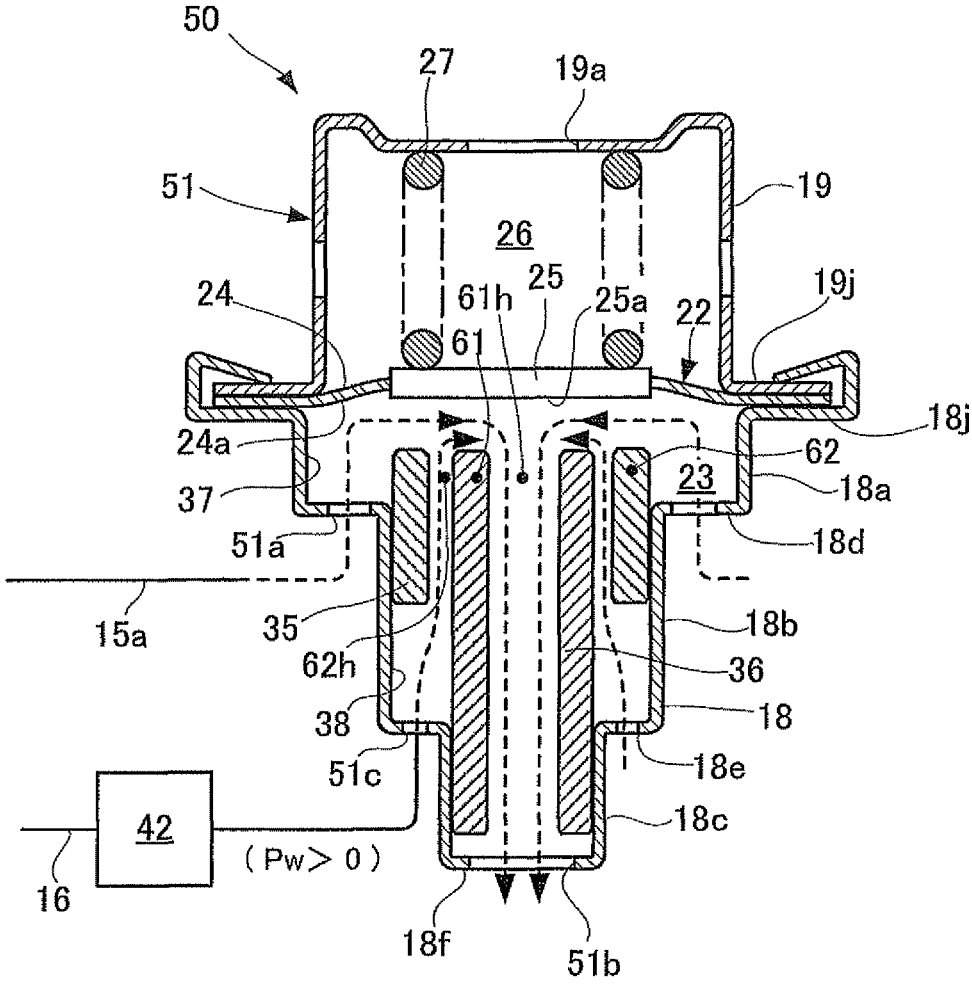
FIG. 7 is a cross-sectional view of an opened state at the low fuel pressure regulation time of the fluid pressure regulation apparatus according to the second embodiment of the present invention.

FIG. 5 to FIG. 7 show the fluid pressure regulation apparatus and the fuel supply apparatus provided with the fluid pressure regulation apparatus according to the second embodiment of the present invention. Since the following embodiment is similar in construction to the first embodiment, the constitution elements and parts of the second embodiment the same as the constitution elements and parts of the first embodiment are illustrated with the reference numerals the same as the reference numerals of the first embodiment shown in FIG. 1 to FIG. 4, and the aspects of the second embodiment different from those of the first embodiment will be explained in detail except for the aspects of the second embodiment the same as those of the first embodiment being omitted hereinafter.

The pressure regulator 50 (fluid pressure regulation apparatus) according to the present embodiment, as shown in FIG. 5 and FIG. 6, has a housing 51 which comprises one housing member 18 and the other housing member 19. The housing member 18 is formed with a first fuel introduction opening 51*a* opened at the first stepped wall portion 18*d*, a fluid discharge opening 51*b* opened at the third stepped wall portion 18*f*, and an intermediate hole 51*c* opened at the second stepped wall portion 18*e*. The first valve seat portion 61 constituted by the inner cylindrical member 36 has the discharge passage 61*h* held in communication with the fluid discharge opening 51*b* and formed in a roughly cylindrical column shape at the inner peripheral surface side of the inner peripheral cylindrical member 36. The discharge passage 61*h* has an opening degree adapted to be varied in response to the displacement of the movable valve body portion 25 in the pressure adjustment chamber 23. Further, the second valve seat portion 62 constituted by the outer cylindrical member 35 has the second fluid pressure introduction passage 62*h* formed in a roughly cylindrical shape between the outer cylindrical member 35 and the inner cylindrical member 36. The second fluid pressure introduction passage 62*h* also has an opening degree adapted to be varied in response to the displacement of the movable valve body portion 25 in the pressure adjustment chamber 23. The second fluid pressure introduction passage 62*h* is adapted to selectively be introduced with the operation pressure fuel (fuel pressure Pw□0) pressurized to the degree applying the operation force to the movable valve body portion 25 through the pressure adjustment switching valve 42 and the intermediate hole 51*c*.

As shown in FIG. 5, the first valve seat portion 61 and the second valve seat portion 62 are arranged in the same direction (upwardly in FIG. 5) in opposing relationship with the flat surface 25*a* of the movable valve body portion 25 and to have respective valve seat surfaces 61*s*, 62*s* (see partially expanded view of FIG. 5) substantially in the same plane with each other and in parallel relationship with each other.

The second fluid pressure introduction passage 62*h* of the pressure regulator 50 is connected to the branch passage 16 forming the circuit portion of the fuel supply circuit 10 at the upstream of the check valve 14. The pressure adjustment switching valve 42 provided on the branch passage 16 is operative to have the second fluid pressure introduction passage 62*h* selectively take a closed state or an opened state. The pressure adjustment switching valve 42 partly constituting the set pressure switching unit 40 is adapted to be controlled by the ECU 41 partly constituting the set pressure switching unit 40.

When the pressure adjustment switching valve 42 is closed, and the fuel pressure Pw in the second fluid pressure introduction passage 62*h* is at a low pressure level (Pw≤0, non-pressurized state), the area of the pressure receiving range of the movable valve body portion 25 of the pressure adjustment member 22 is restricted only to the annular pressure receiving surface of the partition wall portion 24 occupying the peripheral portion of the movable valve body portion 25 and its neighboring portion. When, on the other hand, the pressure adjustment switching valve 42 is opened, and the fuel pressure Pw in the second fluid pressure introduction passage 62*h* is at a high pressure level (Pw>0, pressurized state), the area of the pressure receiving range of the pressure adjustment member 22 includes the annular pressure receiving surface facing the second valve seat portion 62 and the second fluid pressure introduction passage 62*h*. The area of the pressure receiving range of the pressure adjustment member 22 is therefore varied, viz., increased or decreased in response to the fuel pressure Pw in the second fluid pressure introduction passage 62*h*. This leads to varying the thrust force in the direction having the movable valve body portion 25 take the opened state, and thereby leads to varying the deflection amount and the spring force of the compression coil spring 27 urging the movable valve body portion 25 from the back pressure chamber 26 to take the closed state. The movable valve body portion 25 is displaced selectively in the valve closing direction or in the valve opening direction against the first valve seat portion 61 and the second valve seat portion 62 depending on whether the fuel pressure Pw in the second fluid pressure introduction passage 62*h* is at a low pressure level or at a high pressure level. When the displacement of the movable valve body portion 25 in the valve closing direction causes the fuel discharge amount of the fuel from the annular introduction side passage 37 in the pressure adjustment chamber 23 to the fluid discharge opening 51*b* to be decreased, the pressure of the fuel in the annular introduction side passage 37 is adjusted to the high fuel pressure. When, on the other hand, the displacement of the movable valve body portion 25 in the valve opening direction causes the fuel discharge amount of the fuel from the annular introduction side passage 37 in the pressure adjustment chamber 23 to the fluid discharge opening 51*b* to be increased, the pressure of the fuel in the annular introduction side passage 37 is adjusted to the low fuel pressure.

As previously mentioned in the above description, the present embodiment is constructed to require no operation fluid to be introduced into the chambers other than the pressure adjustment chamber 23 for switching the fuel pressure between the high and low pressures for the pressure adjustment, and to have the fuel pressure introduction passage 62*h* function as a part of an operation pressure fuel introduction passage to be used for switching the set pressures at the time of adjusting the fuel pressure to the low fuel pressure. This makes it possible to provide the pressure regulator 50 which enables the pipes to be simple in construction and compact in arrangement.

Moreover, the set pressure of the pressure regulator 50 is maintained at a high pressure level when the pressurized fuel to be supplied to the injectors 3 is stopped, thereby making it possible to promptly start supplying the fuel at a sufficiently high pressure to the injectors 3 at the time of restarting supplying the pressurized fuel, and thereby making it possible to downsize the fuel pump 11 and to reduce the consumption power of the fuel pump 11.

Further, the present embodiment is constructed to have the discharge passage 61*h* formed at the inner peripheral surface side of the inner cylindrical member 36, and to have the second fluid pressure introduction passage 62*h* formed between the outer cylindrical member 35 and the inner cylindrical member 36, so that the pressure adjustment set value can be varied in response to the presence or absence of the operation pressure fuel pressurized and supplied to the second fluid pressure introduction passage 62*h*. Further, the fact that the second fluid pressure introduction passage 62*h* is connected to the circuit portion of the fuel pressure supply circuit 10 at the upstream of the check valve 14 makes it possible to perform the switching operation of the fuel pressure by the pressure adjustment switching valve 42 which is of a low consumption electric current and of a small size. In addition, the throttling action of the pressure adjustment switching valve 42 makes it possible to have the flow amount of the fuel pressurized and introduced into the second fluid pressure introduction passage 62*h* maintained at a relatively small and stable amount of fuel, thereby making it possible to carry out the switching operation of the fuel pressure while maintaining the discharge amount of surplus fuel from the fluid discharge opening 51*b* to a stable amount. The pressure adjustment switching valve 42 constructed to take a closed state at all times renders it possible to start the switching operation of the fuel pressure when the switching operation is required, and to have the pressure regulator 50 adjusted and set to the low pressure side when the apparatus is in a usual operation, thereby making it possible to reduce the consumption power of the fuel pump and the like to an even lower level. Therefore, the present embodiment can also provide a fuel supply apparatus which is low in consumption power.

Third Embodiment

Figure 8:
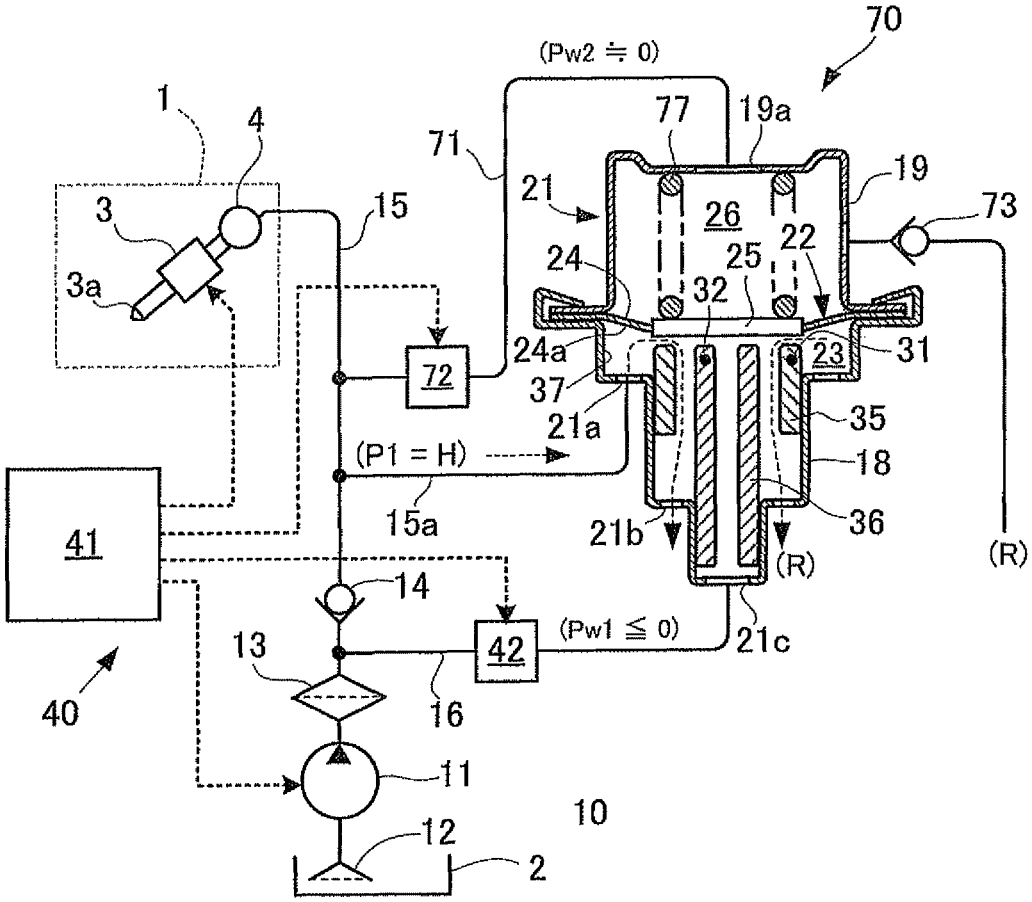
FIG. 8 is a schematic construction view of the fuel supply apparatus according to the third embodiment of the present invention.

FIG. 8 shows the fluid pressure regulation apparatus and the fuel supply apparatus provided with the fluid pressure regulation apparatus according to the third embodiment of the present invention.

The pressure regulator 70 (fluid pressure regulation apparatus) according to the present embodiment comprises, in addition to the constitution elements constituting the first embodiment, a branch passage 71 forming the circuit portion of the fuel supply circuit 10 at the downstream of the check valve 14 and connected to the back pressure chamber 26, a back pressure switching valve 72 of an electromagnet type controlled by the ECU 41 to have the branch passage 71 selectively opened or closed, and a check valve 73 for discharging surplus fuel in the back pressure chamber 26 to the fuel tank 2 by being opened when the pressure of the fuel in the back pressure chamber 26 exceeds the preliminarily set pressure. The pressure regulator 70 thus constructed can selectively introduce the operation pressure fuel (back pressure operating fluid pressure) into the back pressure chamber 26 by way of the branch passage 71 and the back pressure switching valve 72.

The ECU 41 is operated to control the pressure adjustment switching valve 42 to introduce the selectively pressurized fuel (Pw1 in FIG. 8) into the fuel pressure introduction passage 32*h* in the pressure adjustment chamber 23. The ECU 41 is operated to further control the back pressure switching valve 72 to be switched for selectively introducing the back pressure operating fluid pressure (Pw2 in FIG. 8) into the back pressure chamber 26, and thus to vary the urging force acting on the movable valve body portion 25 of the pressure adjustment member 22 in the valve opening and closing directions.

The compression coil spring 77 in the back pressure chamber 26 in the present embodiment has an urging force in the valve closing direction smaller than that of the compression coil spring 27 in the first embodiment. The pressure adjustment switching valve 42 and the back pressure switching valve 72 respectively have electromagnet operation units, and are adapted to be opened when the electromagnet operation units are energized while being closed when the electromagnet operation units are deenergized. The remaining elements and parts constituting the pressure regulator 70 of the present embodiment are the same as those of the pressure regulator 20 of the first embodiment.

The pressure regulator 70 of the present embodiment is adapted to take a state to perform the pressure adjustment to the low fuel pressure when the pressure adjustment switching valve 42 takes an opened state while the back pressure switching valve 72 takes a closed state. The pressure regulator 70 is adapted to take a state to perform the pressure adjustment to the intermediate fuel pressure when the pressure adjustment switching valve 42 and the back pressure switching valve 72 concurrently take respective closed states. The pressure regulator 70 is adapted to take a state to perform the pressure adjustment to the high fuel pressure when the pressure adjustment switching valve 42 takes a closed state while the back pressure switching valve 72 takes an opened state. Further, the pressure regulator 70 can take a state to perform the pressure adjustment to the fuel pressure higher than the above intermediate fuel pressure and lower than the above high fuel pressure when the pressure adjustment switching valve 42 and the back pressure switching valve 72 concurrently take respective opened states.

It will be understood from the foregoing description that the switching operation of the pressure adjustment switching valve 42 makes it possible to adjust the pressure of the fuel in the pressure adjustment chamber 23 while switching to one desired set pressure selected from either one of the high pressure side set pressure and the low pressure side set pressure preliminarily set. In addition to the above switching operation of the pressure adjustment switching valve 42, the switching operation of the back pressure switching valve 72 makes it possible to selectively raise the back pressure urging the movable valve body portion 25 of the pressure adjustment member 22 in the valve closing direction, thereby making it possible to set the fuel pressure adjustment set value to multi-stages, three or more stages exceeding two stages including a high pressure side and a low pressure side.

Similarly to the first embodiment, the present embodiment is constructed to allow the area of the pressure receiving range of the pressure adjustment member 22 receiving the fuel pressure in the valve opening direction to be varied in response to the operation pressure of the fuel in the fuel pressure introduction passage 32*h*, so that the present embodiment can obtain an advantageous effect the same as that of the first embodiment.

Moreover, the present embodiment is constructed to enable the fuel pressure to be switched to the multi-stages, and thus can adjust an adequate fuel pressure to the flow amount of fuel from the low flow amount to the high flow amount even with no expanded dynamic range (ratio of the maximum injection amount and the minimum injection amount) of the injector, thereby making it possible to raise the fuel injection capacity of the injector, and thus to reduce the cost of the injector.

There has been explained in the first embodiment about the fact that the area of the pressure receiving range of the pressure adjustment member 22 is varied when the fluid pressure is introduced into any one of the annular introduction side passage 37 in the pressure adjustment chamber 23 and the fuel pressure introduction passage 32*h* (the plurality of fluid pressure introduction passages), and when the fluid pressure is introduced into both of the fuel pressure introduction passages. Moreover, it may be considered that the area of the pressure receiving range of the pressure adjustment member 22 is varied by introducing the fluid pressure into any one of the annular introduction side passage 37 in the pressure adjustment chamber 23 and the fuel pressure introduction passage 32*h* in the case that the area of the pressure receiving range of the annular pressure receiving surface 24*a* of the partition wall portion 24 facing the annular introduction side passage 37 and the roughly circular pressure receiving surface (the central portion of the flat surface 25*a*) of the central portion of the movable valve body portion 25 facing the second valve seat portion 32 and the fuel pressure introduction passage 32*h* are sufficiently differentiated from each other. Of course, the other embodiments are the same as the above first embodiment.

Although the above embodiments have been explained with the fuel supply apparatus of an in-tank type, the pressure regulator constituting the fluid pressure regulation apparatus according to the present invention may be disposed in the vicinity of the delivery pipe 4. The outer cylindrical member 35 and the inner cylindrical member 36 has been explained as produced separately from the housing 21 and then fastened to the housing 21, however, the outer cylindrical member 35 and the inner cylindrical member 36 may be integrally formed according to the present invention. Further, the pressurized operation pressure fuel is not limited to those for the operation pressure as the discharge pressure of the fuel discharged from the fuel pump 11 of the fuel supply circuit 10 but can be those for the operation pressure lower than the supply fuel pressure from the fuel pressure supply circuit 10 for example by allowing the pressure adjustment switching valve 42 and the back pressure switching valve 72 to have their respective throttling functions for adequately reducing the pressure of the fuel. It may be considered that the pressure of the operation pressure fuel is varied to perform the switching actions of the pressure adjustment values at the multi-stages.

Although the above embodiments have been explained raising an example in which the pressure adjustment member 22 partly forming the pressure adjustment chamber 23 has one surface side space in which the first valve seat portions 31, 61 and the second valve seat portions 32, 62 are disposed, a plurality of any one or both of these valve seat portions may be disposed at the one surface side. In this case, it is, however, not easy to generate negative pressure in the fuel in the housing 21.

Further, the third embodiment has been explained about the case in which the back pressure chamber 26 allows the operation pressure fuel pressurized to the operation pressure to be introduced therein, however, it may be considered that the back pressure chamber 26 allows the operation pressure fluid other than the fuel to be introduced therein, and that the operation pressure fluid at a negative pressure but not at a positive pressure is introduced therein if the pressure regulator is arranged in the neighborhood of the delivery pipe.

Further, the pressure adjustment member 22 in each of the above embodiments has been explained as having a partition wall portion 24 constituted by a diaphragm and a movable valve portion 25 in a plate shape, however, the partition wall portion 24 may be in the form of a piston slidably supported on the housing, or otherwise may support the back surface portion of the movable valve portion 25 according to the present invention. The movable valve portion 25 may be in the form of a roughly circular plate bent to have an arcuate cross-section for example of a concave or convex shape as a whole, and may not be necessarily in a plate shape according to the present invention.

Each of the embodiments have been explained raising an example in which the fuel consumption unit is constituted by a gasoline engine used for a vehicle to consume gasoline but can be used for an engine consuming another fuel other than the gasoline, or otherwise can be applied to an engine used for other than the vehicle according to the present invention. For performing the high/low pressure switching operation of the fuel pressure at various kinds of fuel consumption units serving to consume fuel to output something, the present invention can be applied. The fluid pressure regulation apparatus according to the present invention can be used as a pressure regulator employing fluid other than the fuel, and can be used for adjusting the desired supply pressure of the fluid to be supplied to the fluid consumption unit to be equal to or lower than the pressure preliminarily set.

As has been explained in the above description, the present invention can provide a fluid pressure regulation apparatus and a fuel supply apparatus having the pipes compact in arrangement and simple in construction, and can be produced at a low cost. The fuel supply apparatus can be of an advantageous effect of enabling low power consumption to be brought about. The present invention is useful for the fluid pressure regulation apparatus suitable for adjusting the fuel supply pressure to the fuel consumption unit during supplying the fuel stored in the fuel tank to the fuel consumption unit by the fuel pump, and useful for the overall fuel supply apparatus provided with the fluid pressure regulation apparatus.

REFERENCE SIGNS LIST

1: engine (internal combustion engine; fuel consumption unit)
2: fuel tank
3: injector (fuel consumption unit)
10: fuel supply circuit
11: fuel pump
13: fuel filter
14: check valve
15: fuel passage
16, 71: branch passage
18, 19: housing member
20, 50, 70: pressure regulator (fluid pressure regulation apparatus, fuel pressure adjustment apparatus, pressure adjustment valve)
21: housing
21*a*: fluid introduction opening
21*b*: fluid discharge opening
22: pressure adjustment member
23: pressure adjustment chamber
24: partition wall portion (diaphragm)
25: movable valve body portion (valve body plate)
25*a*: flat surface
26: back pressure
27, 77: back pressure chamber
27, 77: compression coil spring (resilient member)
31, 61: first valve seat portion
31*h*, 61*h*: discharge passage
31*s*, 32*s*, 61*s*, 62*s*: valve seat surface
32, 62: second valve seat portion
32*h*, 62*h*: second fluid pressure introduction passage
35: outer cylindrical member
36: inner cylindrical member
40: set pressure switching unit
41: ECU (electronic control unit)
42: pressure adjustment switching valve (opening/closing valve, switching valve)
72: back pressure switching valve
P1: system pressure (pressure adjusted fuel pressure)

The invention claimed is:

1. A fluid pressure regulation apparatus comprising:

a housing formed to have a fluid introduction opening through which fluid is introduced, and a fluid discharge opening through which the fluid is discharged, and in the housing formed a pressure adjustment chamber which is held in communication with the fluid introduction opening, and a pressure adjustment member in the form of a partition wall and capable of communicating the fluid introduction opening with the fluid discharge opening in response to the fluid pressure in the pressure adjustment chamber, the fluid pressure in the pressure adjustment chamber being adjustable to a preliminarily set pressure, the pressure adjustment member forming an area of a pressure receiving range receiving the fluid pressure in the pressure adjustment chamber at one surface side thereof, the area being variably set, and the set pressure being varied in response to the area of the pressure receiving range.

2. The fluid pressure regulation apparatus as set forth in claim 1, in which a plurality of fluid pressure introduction passages are formed at the one surface side of the pressure adjustment member partly forming the pressure adjustment chamber, and the fluid pressure is selectively introduced to the plurality of fluid pressure introduction passages to variably set the area of the pressure receiving range.

3. The fluid pressure regulation apparatus as set forth in claim 2, which further comprises an opening/closing valve operative to be opened to introduce the fluid into any one of the fluid pressure introduction passages and to be closed to regulate the introduction of the fluid.

4. The fluid pressure regulation apparatus as set forth in claim 2, in which the pressure adjustment member includes a partition wall portion forming the pressure adjustment chamber together with the housing, and a movable valve body portion displaceable in an opening direction having the pressure adjustment chamber brought into communication with the fluid discharge opening in response to the fluid pressure in the pressure adjustment chamber, the housing being provided therein with a first valve seat portion and a second valve seat portion, the first valve seat portion partly forming at the one surface side of the pressure adjustment member a discharge passage held in communication with the fluid discharge opening and a first fluid pressure introduction passage held in communication with the fluid introduction opening, the first valve seat portion being operative to allow the discharge passage to be brought into communication with the first fluid pressure introduction passage in response to the displacement of the movable valve body portion, the second valve seat portion partly forming at the one surface side of the pressure adjustment member a second fluid pressure introduction passage allowing the fluid pressure to be introduced therein, the second valve seat portion being operative to allow the discharge passage to be brought into communication with the second fluid pressure introduction passage in response to the displacement of the movable valve body portion.

5. The fluid pressure regulation apparatus as set forth in claim 4, in which the first valve seat portion and the second valve seat portion are disposed in concentric relationship with each other.

6. The fluid pressure regulation apparatus as set forth in claim 4, in which the first valve seat portion and the second valve seat portion are arranged in the same direction in opposing relationship with the movable valve body portion of the pressure adjustment member and to have respective valve seat surfaces in parallel relationship with each other.

7. The fluid pressure regulation apparatus as set forth in claim 6, in which the movable valve body portion of the pressure adjustment member has a flat surface facing the first valve seat portion and the second valve seat portion.

8. The fluid pressure regulation apparatus as set forth in claim 4 in which the first valve seat portion and the second valve seat portion are respectively constituted by the end portions of an outer cylindrical member and an inner cylindrical member disposed in coaxial relationship with each other, the fluid introduction opening formed in the housing is positioned at the outer peripheral surface side of the outer cylindrical member, and the fluid discharge opening formed in the housing is positioned at the inner peripheral surface side of the outer cylindrical member.

9. The fluid pressure regulation apparatus as set forth in claim 8, in which the discharge passage is formed between the outer cylindrical member and the inner cylindrical member, and the second fluid pressure introduction passage is formed at the inner surface side of the inner cylindrical member.

10. The fluid pressure regulation apparatus as set forth in claim 8, in which the discharge passage is formed at the inner peripheral surface side of the inner cylindrical member, and the second fluid pressure introduction passage is formed between the outer cylindrical member and the inner cylindrical member.

11. The fluid pressure regulation apparatus as set forth in claim 4, in which the partition wall portion of the pressure adjustment member partly forms a back pressure chamber together with the housing to impart the back pressure to the pressure adjustment chamber, the back pressure chamber accommodates therein a resilient member to resiliently urge the movable valve body portion of the pressure adjustment member in a closing direction, and the fluid pressure in the pressure adjustment chamber is adjusted to a high fluid pressure when the fluid pressure in the second fluid pressure introduction passage is released, and the fluid pressure in the pressure adjustment chamber is adjusted to a low fluid pressure when the fluid pressure in the second fluid pressure introduction passage is pressurized.

12. The fluid pressure regulation apparatus as set forth in claim 11, in which the partition wall portion of the pressure adjustment member is constituted by a flexible diaphragm, and the movable valve body portion of the pressure adjustment member is constituted by a valve body plate supported on the central portion of the diaphragm to be in opposing relationship with the first valve seat portion and the second valve seat portion.

13. A fuel supply apparatus provided with the fluid pressure regulation apparatus as set forth in claim 1, in which the pressure of fuel to be supplied to a fuel consumption unit is adjusted by the fluid pressure regulation apparatus.

14. The fuel supply apparatus provided with the fluid pressure regulation apparatus as set forth in claim 4 and a fuel supply circuit that supplies the fuel to a fuel consumption unit through a check valve, in which the first fluid pressure introduction passage of the fluid pressure regulation apparatus is connected to a circuit portion at the downstream side of the check valve of the fuel supply circuit, and the second fluid pressure introduction passage of the fluid pressure regulation apparatus is connected to a circuit portion at the upstream side of the check valve of the fuel supply circuit.

15. The fuel supply apparatus as set forth in claim 14, which further comprises a switching valve capable of switching the state selectively to a closing valve state in which the second fluid pressure introduction passage is closed or to an opening valve state in which the second fluid pressure introduction passage is opened, and when the opening/closing valve is switched to the closing valve state in the state in which the fuel flows from the fluid introduction opening to the fluid discharge opening, the flow of the fuel causes negative pressure to be generated in the vicinity of the facing portion between the movable valve body portion and the second valve seat portion and between the movable valve body portion and the second fluid pressure introduction passage.

16. The fuel supply apparatus as set forth in claim 15, in which the partition wall portion of the pressure adjustment member separates the inside of the housing into the pressure adjustment chamber and the back pressure chamber imparting the back pressure to the pressure adjustment chamber, further comprising a back pressure switching valve for selectively introducing the fluid pressure into the back pressure chamber to vary the pressure in the back pressure chamber.

17. The fuel supply apparatus as set forth in claim 13, in which the fuel consumption unit is a fuel injection portion of an internal combustion engine.

* * * * *